US012127639B1

(12) United States Patent
Doudak

(10) Patent No.: US 12,127,639 B1
(45) Date of Patent: Oct. 29, 2024

(54) PERMANENT JEWELRY AND METHOD OF MAKING SAME

(71) Applicant: RIVA JEWELRY MANUFACTURING, INC., Brooklyn, NY (US)

(72) Inventor: Rizkallah Doudak, Brooklyn, NY (US)

(73) Assignee: RIVA JEWELRY MANUFACTURING, INC., Brooklyn, NY (US)

( * ) Notice: Subject to any disclaimer, the term of this patent is extended or adjusted under 35 U.S.C. 154(b) by 0 days.

(21) Appl. No.: 18/655,600

(22) Filed: May 6, 2024

Related U.S. Application Data

(63) Continuation of application No. 18/381,224, filed on Oct. 18, 2023, now Pat. No. 12,004,608.

(51) Int. Cl.
*A44C 5/00* (2006.01)
*A44C 5/20* (2006.01)
*A44C 27/00* (2006.01)

(52) U.S. Cl.
CPC ..... *A44C 5/0084* (2013.01); *A44C 5/2066* (2013.01); *A44C 27/00* (2013.01)

(58) Field of Classification Search
CPC ..... Y10T 292/48; Y10T 292/49; Y10T 292/4945; Y10T 24/47; Y10T 29/49954; Y10T 24/45016; Y10T 403/5741; Y10T 24/3967; Y10T 24/505; F16B 19/06; F16B 2200/60; F16B 21/10; F16B 19/004; F16B 17/004; G09F 3/0323; G09F 3/0305; G09F 3/0317; G09F 3/0341; G09F 3/037; G09F 3/005; G09F 3/0364; G09F 3/0352; G09F 3/0347; G09F 3/0311; G09F 3/03; G09F 3/00; G09F 2/14; A44C 5/2076; A44C 5/0053; A44C 5/0061; A44C 5/0069; A44C 5/0076; A44C 5/0084; A44C 5/2066; A44C 27/00; A44C 5/0092; A44C 5/00; A44C 5/102; A44C 5/10; A44C 5/185; A44C 13/00; F16G 11/00; F16G 15/02
See application file for complete search history.

(56) References Cited

U.S. PATENT DOCUMENTS 3,823,443 A 7/1974 Takabayashi
4,464,854 A 8/1984 Hall
(Continued)

FOREIGN PATENT DOCUMENTS

WO 93021791 11/1993

*Primary Examiner* — Jack W Lavinder
(74) *Attorney, Agent, or Firm* — Weitzman Law Offices, LLC

(57) ABSTRACT

An item of permanent jewelry involves a Band including a hollow extending longitudinally into the Band from a first terminal end, an internal bar having a first terminal end inserted into the hollow, wherein the Band is connected to the internal bar by at least one pin extending transversely through both the first terminal end of the Band and the first terminal end of the internal bar, and wherein the second terminal end of the Band and second terminal end of the internal bar are coupled together such so that the Band and internal bar collectively form a closed loop such that the closed loop cannot be slid off the person without damaging at least one of the Band, the internal bar or the at least one pin. A method of making an item of permanent jewelry is also disclosed.

14 Claims, 20 Drawing Sheets

(56) References Cited

U.S. PATENT DOCUMENTS

| | | | | |
|---|---|---|---|---|
| 5,343,608 | A * | 9/1994 | MacDonald | G09F 3/205 63/3 |
| 5,459,909 | A | 10/1995 | Nussberger | |
| 6,109,673 | A * | 8/2000 | Olshausen | G09F 3/0317 292/307 R |
| 2003/0159463 | A1 | 8/2003 | Rosenberg | |
| 2005/0066563 | A1 * | 3/2005 | Juhan | E05B 73/0017 40/633 |
| 2014/0189935 | A1 | 7/2014 | Tucker | |

* cited by examiner

FIG. 42
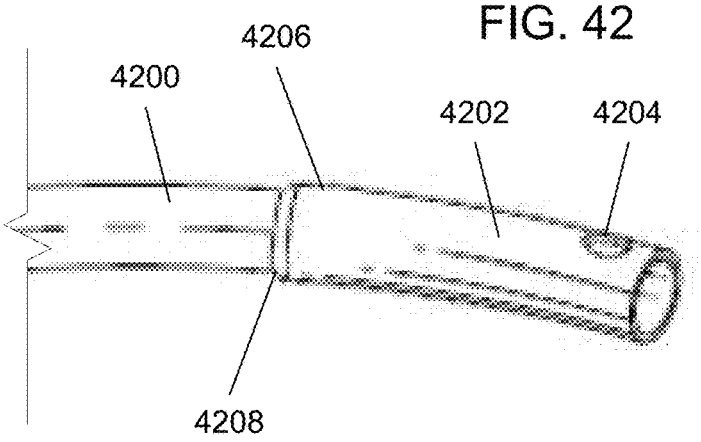
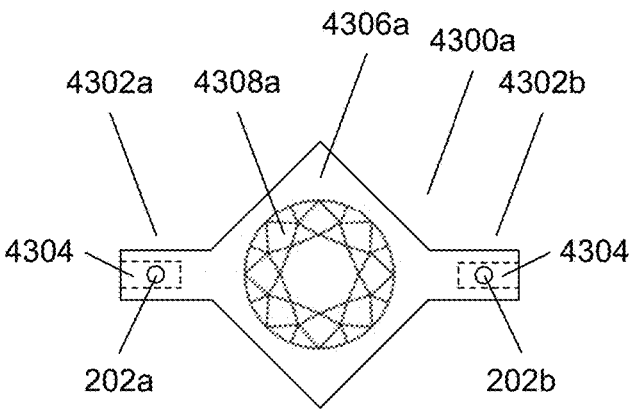
FIG. 43A
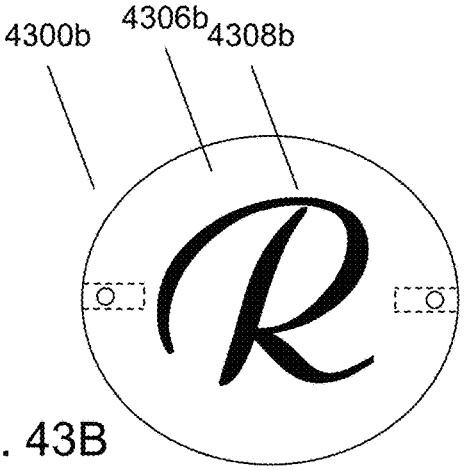
FIG. 43B
FIG. 43C
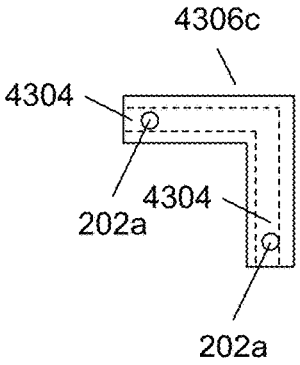
FIG. 44
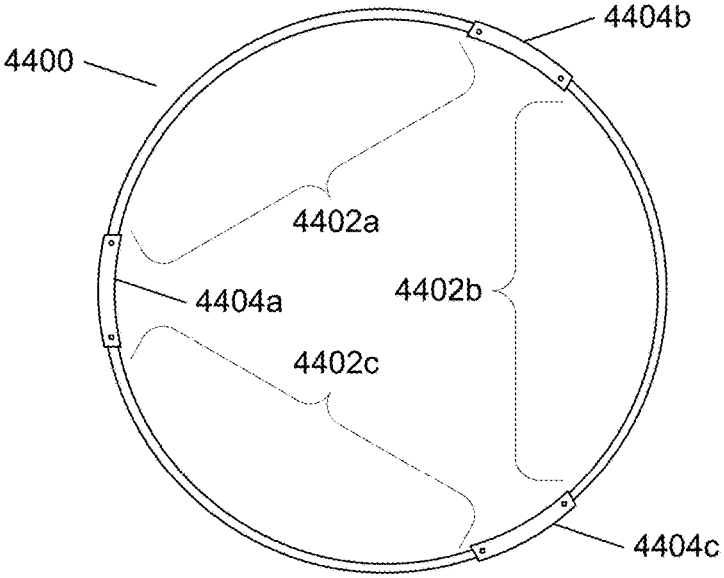

PERMANENT JEWELRY AND METHOD OF MAKING SAME

CROSS REFERENCE TO RELATE APPLICATIONS

This application is a continuation of U.S. patent application Ser. No. 18/381,224 filed Oct. 18, 2023, the entirety of which is incorporated herein by reference.

FIELD OF THE INVENTION

This disclosure relates generally to jewelry and, more particularly, to permanent jewelry.

BACKGROUND

"Permanent" jewelry are items of jewelry, such as bracelets, bangles, anklets, necklaces, chokers and rings, that lack an opening or a clasp, toggle or closure and are sized so that, when on the wrist, ankle, neck or finger, they cannot be physically removed from the wrist over the hand, ankle over the foot, neck over the head or finger over the proximal interphalageal joint, without damaging the item.

Permanent jewelry has become very popular.

Permanent jewelry is currently created by joining the ends of the bracelet, bangle, anklet or necklace using micro welding (micro TIG, laser micro or pulsed arc) techniques. To do so, however requires the components (chains, wires or jump rings) that will be joined to be very thin in order to ensure a solid connection is made. As a result, a drawback to permanent jewelry is that the components tend to be fragile, and can break easily.

It is difficult to use thicker components for permanent jewelry several reasons. First, the joining must necessarily be done while the jewelry is being worn. Micro welding (a form of spot welding) applies heat to fuse together the two pieces to be joined. Thus, to avoid burning the wearer, the joining process must be performed quickly, so thinner pieces make that possible. Second, to ensure a solid connection with thicker pieces, multiple welds must be done about the periphery of the joint area. This can be difficult on the underside of the jewelry item, both through physical placement and in a way that obtains a good connection. Third, with thicker components, the necessary micro welds become more visible and, by their very nature, are not aesthetically pleasing to look at.

In addition, micro welding requires skill and training to avoid using power that is too low or high and to ensure that the intended wearer does not get injured from the joining process.

Still further, permanent jewelry is often made available at temporary locations, such as fairs, exhibitions, etc., yet the machinery used to perform micro welding (e.g. welder, microscope or viewer, argon canister), are bulky and can be awkward or heavy for a permanent jewelry seller to carry around from place to place.

Finally, in order to be aesthetically pleasing, and in some cases have appropriate strength, it can be critical that the two ends to be micro welded be perfectly aligned. This also takes skill and practice.

There are presently no satisfactory solutions for the aforementioned issues individually or collectively.

SUMMARY

This disclosure describes solutions that provide significant advances in addressing the aforementioned problems.

One aspect of this disclosure involves an item of permanent jewelry including a Band including a first terminal end and a second terminal end, wherein the first terminal end of the Band includes a first hollow extending longitudinally into the first terminal end, and a first through hole extending transversely through the Band and the first hollow. The item of permanent jewelry further includes an internal bar having a first terminal end and a second terminal end, wherein the first terminal end of the internal bar includes a first through hole extending transversely therethrough. The internal bar is inserted into the Band such that the first terminal end of the internal bar is within the first terminal end of the Band and the respective first through holes of the internal bar and the Band are aligned so as to form a first passage extending from a first exterior side of the Band through the internal bar to a second exterior side of the Band opposite the first exterior side. A first pin is within at least the first passage, the pin extending through the aligned first through holes of both the Band and internal bar, wherein the first pin is compressed on both sides of the aligned through holes such that the first pin cannot slide out of the aligned first through holes. Wherein the second terminal end of the Band is coupled to the internal bar such that, when joined and on a wearer, a closed loop involving the Band and the internal bar is formed such that the closed loop cannot be removed by the wearer without damaging at least one of the Band, the internal bar or the first pin.

Another aspect of this disclosure involves an item of permanent jewelry including a Band including a hollow extending longitudinally into the Band from a first terminal end, an internal bar having a first terminal end inserted into the hollow, wherein the Band is connected to the internal bar by at least one pin extending transversely through both the first terminal end of the Band and the first terminal end of the internal bar, and wherein the second terminal end of the Band and second terminal end of the internal bar are coupled together such so that the Band and internal bar collectively form a closed loop such that the closed loop cannot be slid off the person without damaging at least one of the Band, the internal bar or the at least one pin.

Yet another aspect of this disclosure involves a method of forming an item of permanent jewelry on a person, the method involves a) coupling a first end of a Band to an internal bar; b) placing the Band about a portion of the person; c) coupling a second end of the Band to the internal bar using a pin so as to form a closed loop about the portion; and d) compressing the pin so that the pin cannot slide out of the internal bar.

BRIEF DESCRIPTION OF THE DRAWINGS

This disclosure is further described in the detailed description that follows, with reference to the drawings, wherein the same reference numbers appearing in the various drawings and description designate corresponding or like elements among the different views, and in which:

FIG. 42 illustrates, in simplified form, an example implementation involving a tube bar that only includes one through hole;

FIG. 43A illustrates, in simplified form an alternative example tube bar;

FIG. 43B illustrates, in simplified form another alternative example tube bar;

FIG. 43C illustrates, in simplified form yet another alternative example tube bar;

FIG. 44 illustrates, in simplified form, another example implementation of an item of permanent jewelry 4400 that can be created by applying the teachings herein;

DETAILED DESCRIPTION

In order to fully understand the scope of the teachings herein for creating permanent jewelry, various specific examples will be provided with the understanding that such teachings can be broadly applied to bracelets, bangles, anklets, necklaces, chokers, or rings whether chain, wire (solid or hollow), jewelry sheet or bar stock and irrespective of the cross sectional or peripheral shape thereof, the cross section (solid or hollow) and peripheral shape, the material (e.g., solid gold, solid silver, sterling silver, gold or silver plate, etc.) as well as the choice of chain or wire being a matter of design choice and aesthetics, and independent of the claimed inventions herein.

For simplicity, as used herein throughout, the term "Band" means, and is intended to mean, individually and collectively, any length of precious metal jewelry chain, jewelry wire (solid or hollow), precious metal sheeting or bar stock (solid or hollow), or any other type of precious metal or precious metal plated material, as well as, in some implementations, stainless steel chain, wire, sheeting or bar stock, that can be part of the loop of a bracelet, bangle, anklet, necklace, choker, or ring.

Figure 1:
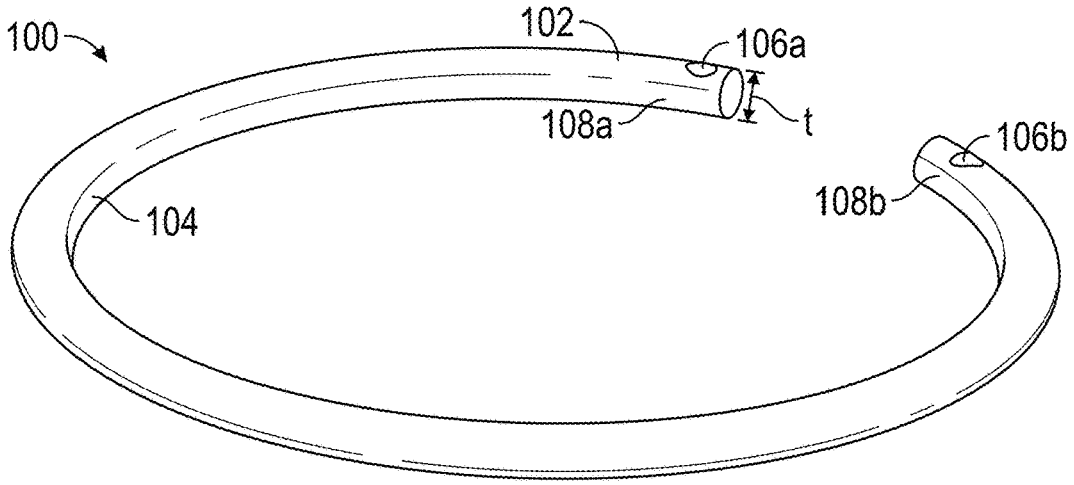
FIG. 1 illustrates, in simplified form, an example of bangle bracelet for a wrist incorporating one aspect of the teachings herein.

FIG. 1 illustrates, in simplified form, an example of bangle bracelet 100 for a wrist incorporating one aspect of the teachings herein. As shown in this example, for simplicity, the bangle bracelet 100 is made up of a Band, in this example, solid wire 102 of a precious metal, and having a thickness (e.g., diameter) "t" that is shaped into a partial loop (e.g., circle or oval). As shown, the surface 104 is smooth and unadorned, however, it is to be understood and appreciated that the surface 104 could be textured or otherwise adorned in some known manner. The bangle bracelet 100 further includes, in this example, a pair of through holes 106*a*, 106*b*. The through holes 106*a*, 106*b* will be used to join the ends 108*a*, 108*b* of the bracelet 100 while on a wearer's wrist and, thereby form a permanent bracelet.

Figure 2:
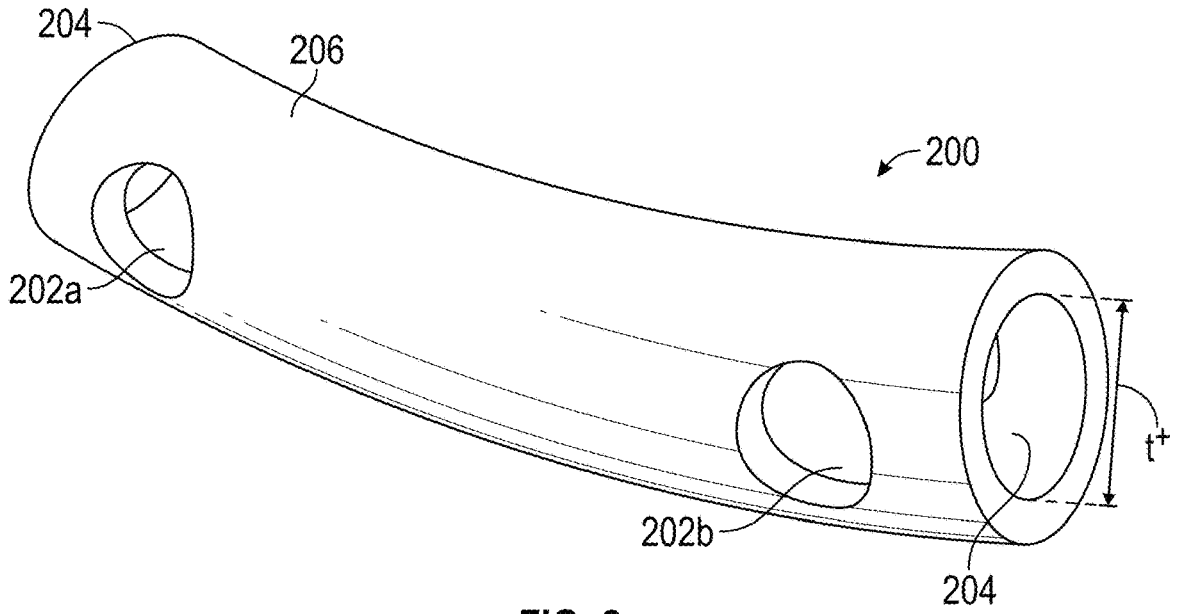
FIG. 2 illustrates, in simplified form, a perspective view of another permanent jewelry component in accordance with the teachings herein, in the form of a tube bar.
Figure 3:
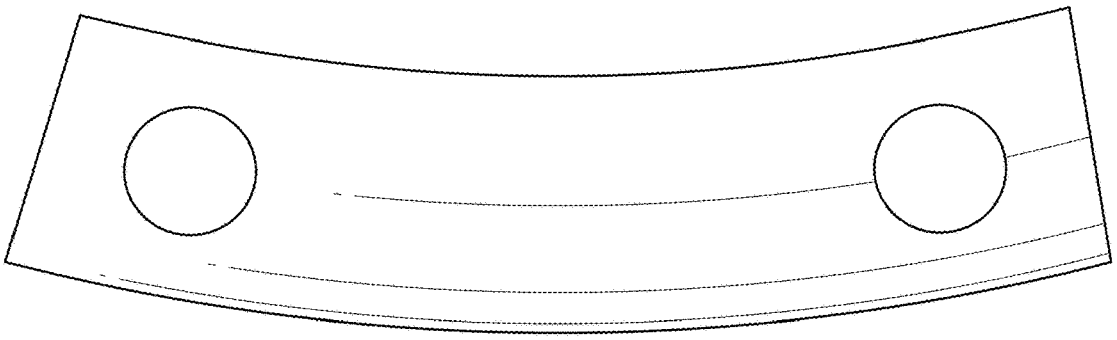
FIGS. 3-6 respectively illustrate, in simplified form, for purposes of understanding, a top view, a right side view, a back view and a front view of the tube bar of FIG. 2.
Figure 4:
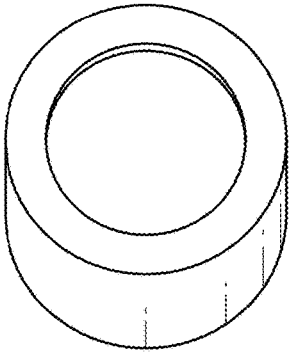
Figure 5:
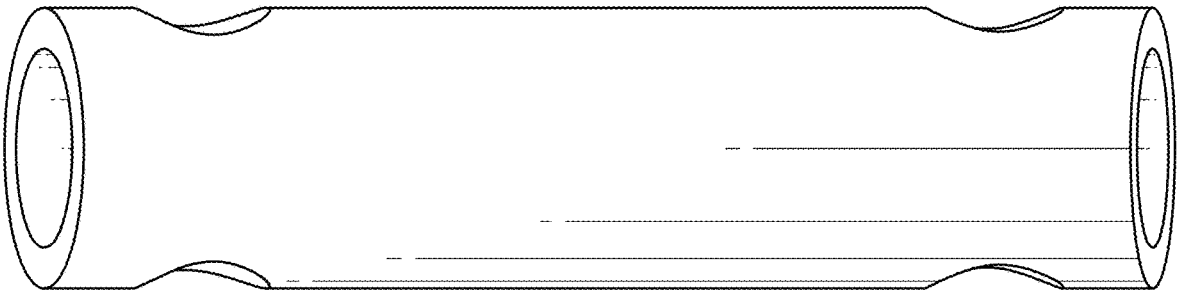
Figure 6:
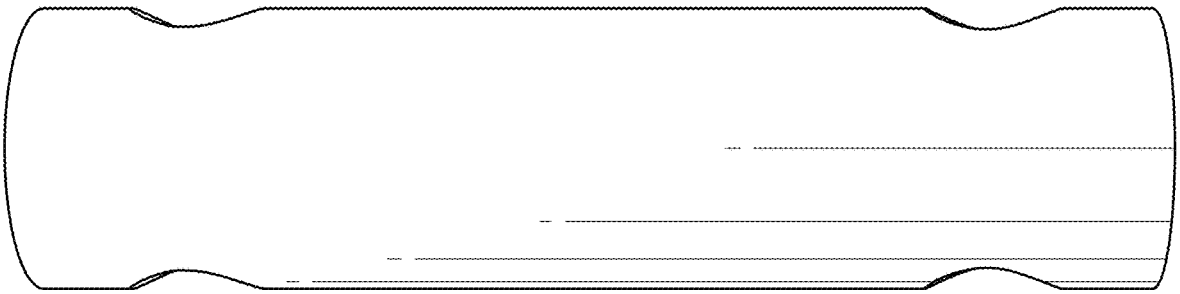

FIG. 2 illustrates, in simplified form, a perspective view of another permanent jewelry component in accordance with the teachings herein, in the form of a tube bar 200. As shown, the tube bar 200 involves a body (typically involving, in whole or part a precious metal, such as gold, silver or platinum, but may also be made of nickel or a precious metal plated base metal) having a pair of through holes 202*a*, 202*b* passing through from one side of the outer surface 206 of the body to the other (i.e., entirely through the tube bar 200), and is sized to correspond to the through holes 106*a*, 106*b* of the bangle bracelet 100. In addition, the tube bar 200 includes a cavity 204 of a size "t+" (i.e., it is sized slightly larger than the ends 108*a*, 108*b* of the bangle bracelet 100) so that an end 108*a*, 108*b* of the bangle bracelet 100 can be inserted therein to at least an internal depth such that the respective through holes 106*a*, 106*b*, 202*a*, 202*b* align. Depending upon the particular implementation, the cavity 204 need not, or can, extend entirely through the tube bar 200.

As shown, the tube bar 200 is depicted as curved, with a curvature radius corresponding to that of the bangle bracelet 100. However, it should be understood and appreciated that other implementations of the tube bar 200 can have a different radius of curvature, it can be straight, or it can have any other shape (overall or in cross section), depending upon its intended prominence and the Band to which it will be attached.

FIGS. 3-6 respectively illustrate, in simplified form, for purposes of understanding, a top view (FIG. 3) (the bottom view being a mirror image thereof), a right side view (FIG. 4) (the left side view being a mirror image thereof), a back view (FIG. 5) and a front view (FIG. 6) of the tube bar 200 of FIG. 2.

To form the permanent jewelry item, in this example, a permanent bangle bracelet, the Band forming the bangle bracelet 100 and tube bar 200 are joined in the following steps, bearing in mind that, unless inherently necessary, certain steps may be performed in a different order or combined.

FIGS. 7-12 illustrate, in simplified form, one example sequence for creating a permanent bangle bracelet using the Band for the bangle bracelet 100 of FIG. 1 and tube bar 200 of FIG. 2.

Figure 7:
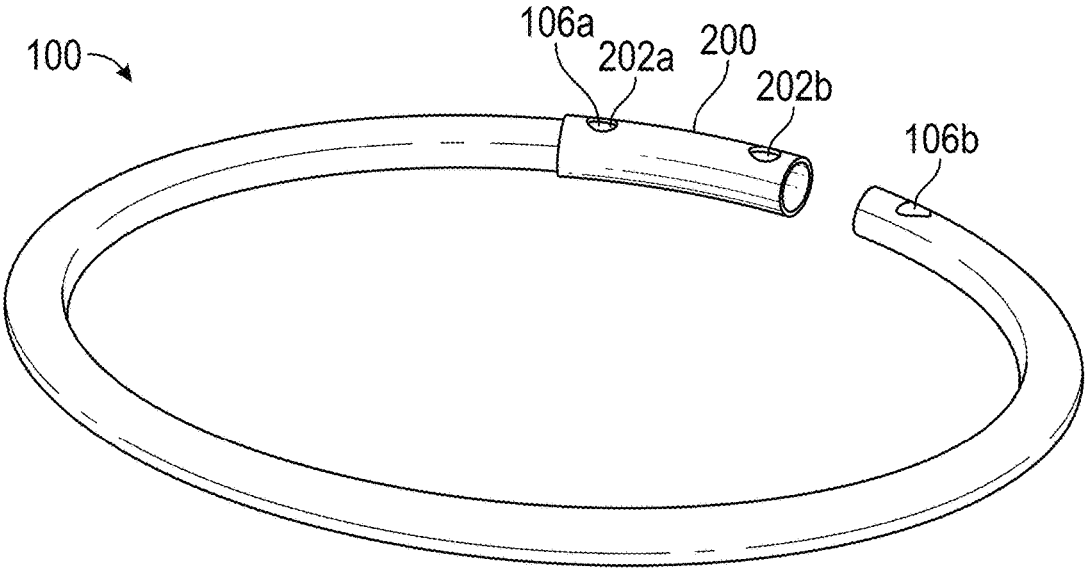
FIGS. 7-12 illustrate, in simplified form, one example sequence for creating a permanent bangle bracelet using the Band of FIG. 1 and tube bar of FIG. 2.

In this regard, as shown in FIG. 7, the end 108*a* is slid into the cavity 204 of the tube bar 200 until the respective through holes 106*a*, 202*b* are aligned.

Figure 8:
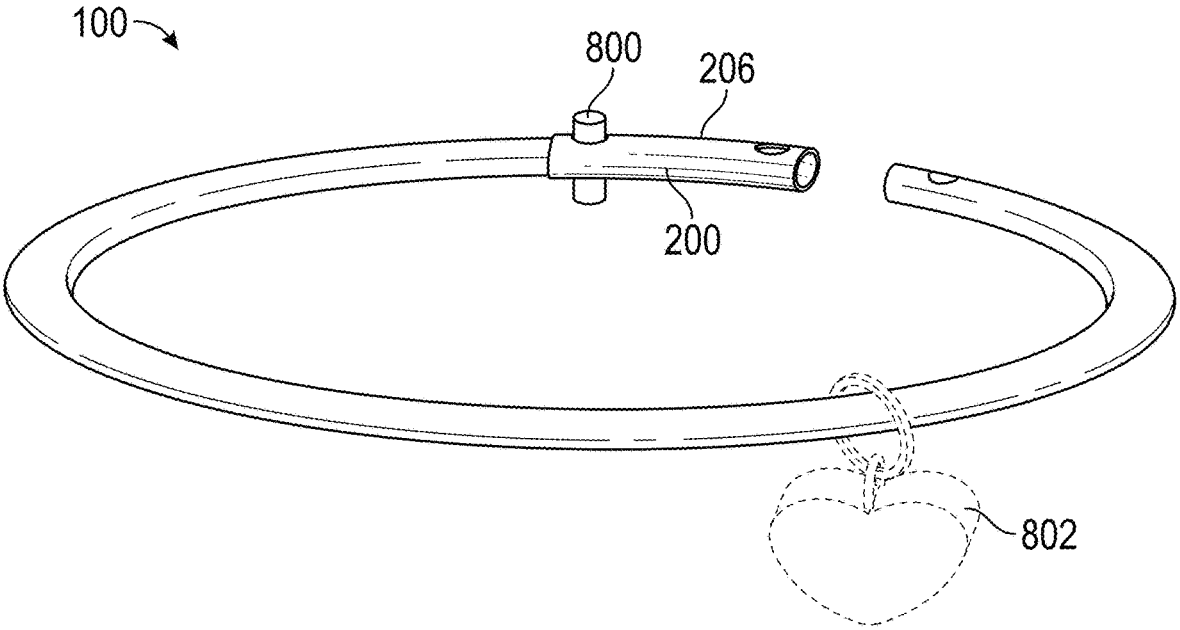

As shown in FIG. 8, a pin 800 sized to snugly fit within the through holes 106*a*, 202*b* is inserted through the through holes 106*a*, 202*b*. The pin 800 has a length (not to scale) such that it extends beyond both side of the outer surface 206 of the tube bar 200. Typically, the pin will be made of the same material as the tube bar 200. However, optionally, for aesthetic contrast, the pin 800 can be selected to contrast with the tube bar, 200. For example, as an aside, the tube bar 200 could be one of plain gold, rose gold or white gold, and the pin 800 could also be selected so that it was plain gold, rose gold or white gold to match the tube bar 200. Alternatively, if the tube bar 200 was plain gold, the pin 800 could be rose gold or white gold, if the tube bar 200 was rose gold, the pin 800 could be plain gold or white gold, or if the if the tube bar 200 was white gold, the pin 800 could be plain gold or rose gold.

As a further aside, optionally at some part of the process prior to the final joining, an adornment, for example a charm 802, can be inserted onto the bangle bracelet 100.

Figure 9:
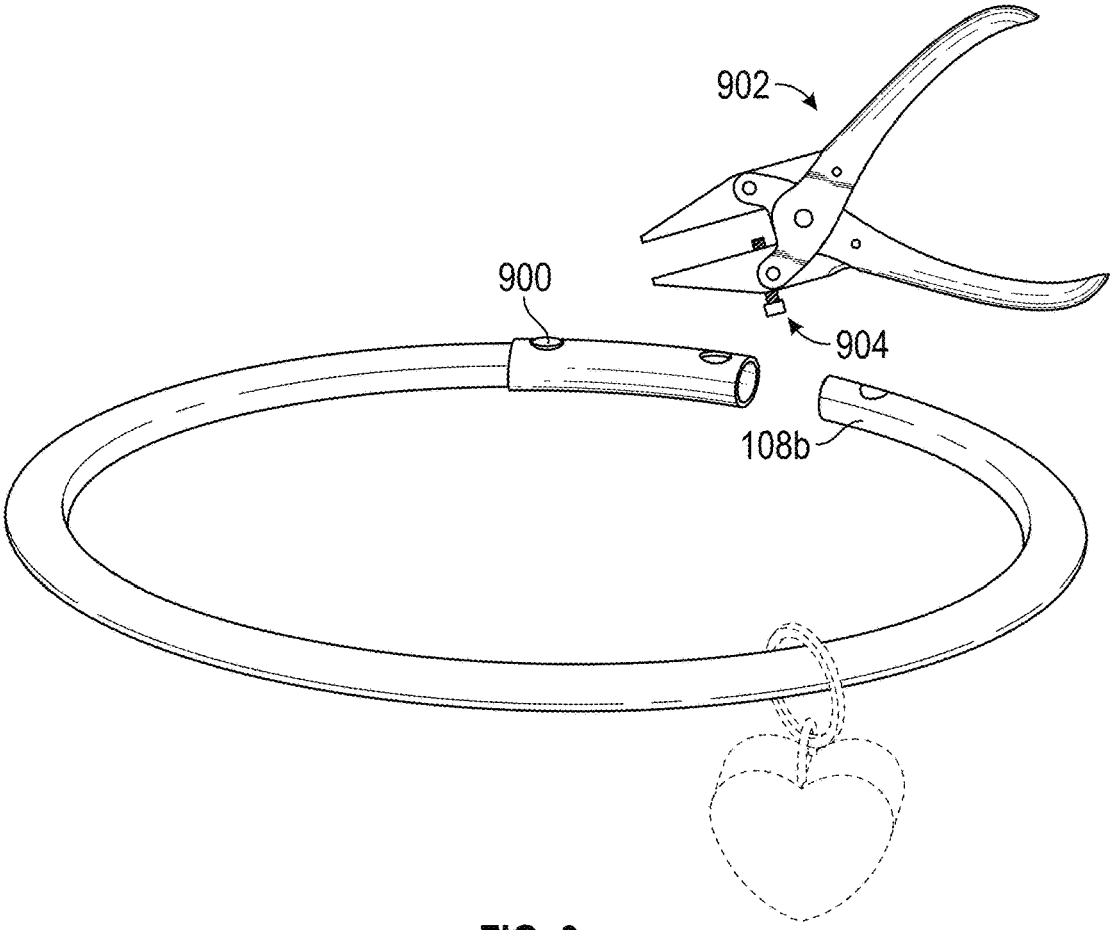

As shown in FIG. 9, the pin 800 is then compressed 900 to lock the bangle bracelet 100 and tube bar 200 together, for example, the pin 800 can be peened using a plate inserted between the wearer and the portion of the pin 800 between the wearer and the tube bar 200 and hitting the opposite end of the pin 800 with a small hammer (not shown), or the pin 800 can be crimped, for example, using a pair of parallel jaw pliers 902. Optionally, if parallel pliers are used, it is desirable to have some form of depth stop 904, for example an adjustable screw or stop block, to limit the crimping of the pin 800 and thereby avoid damaging or deforming the tube bar 200. The peening or crimping compresses and deforms both ends of the pin 800 and ensures that the pin 800 cannot slide out of the aligned through holes of the Band and tube bar 200.

Figure 10:
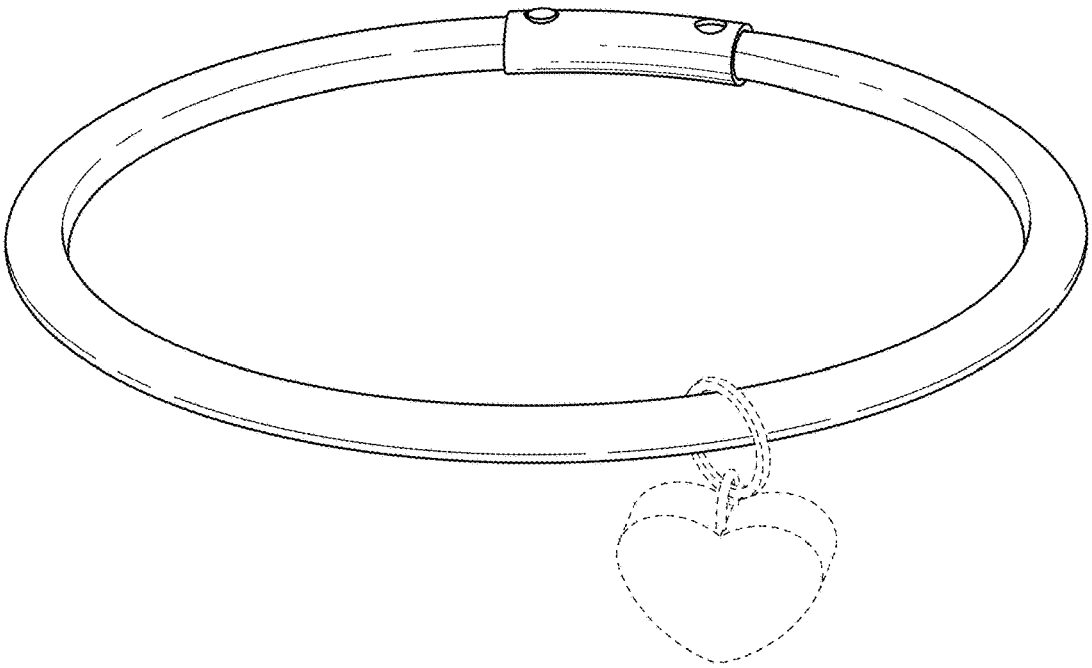

As shown in FIG. 10, the opposite end 108*b* of the Band is then inserted into the opposite end of the tube bar 200.

Figure 11:
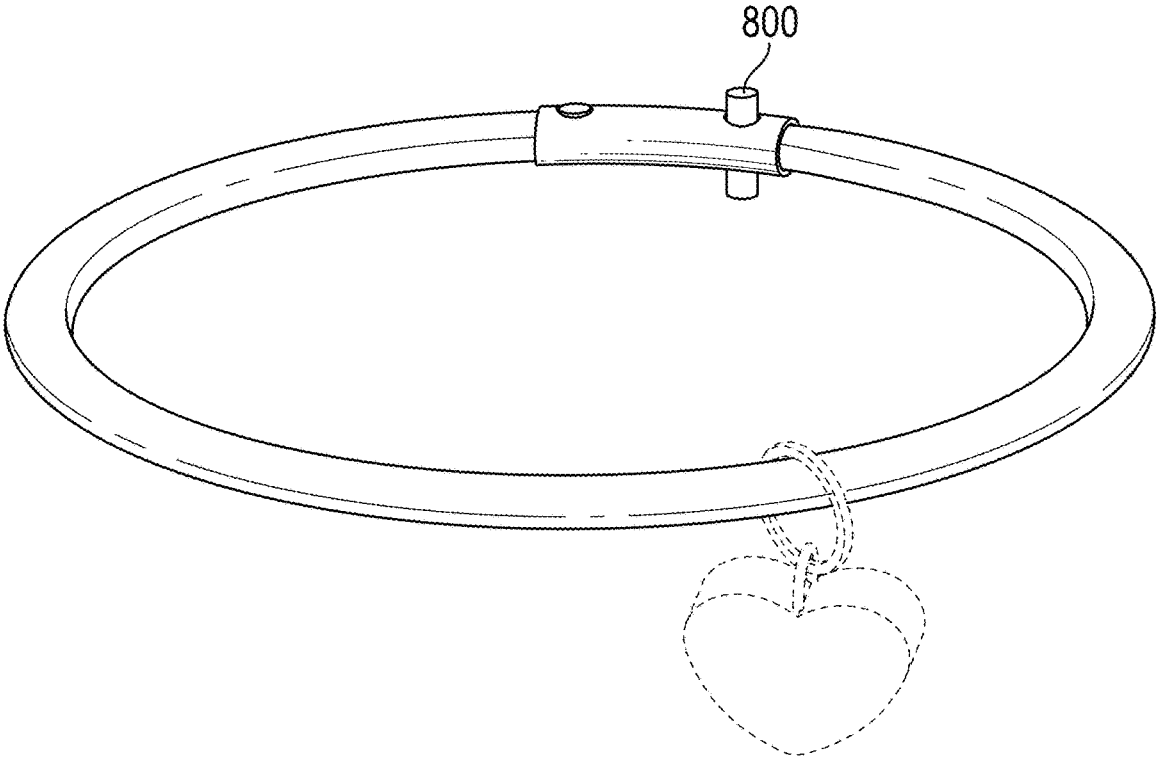
Figure 12:
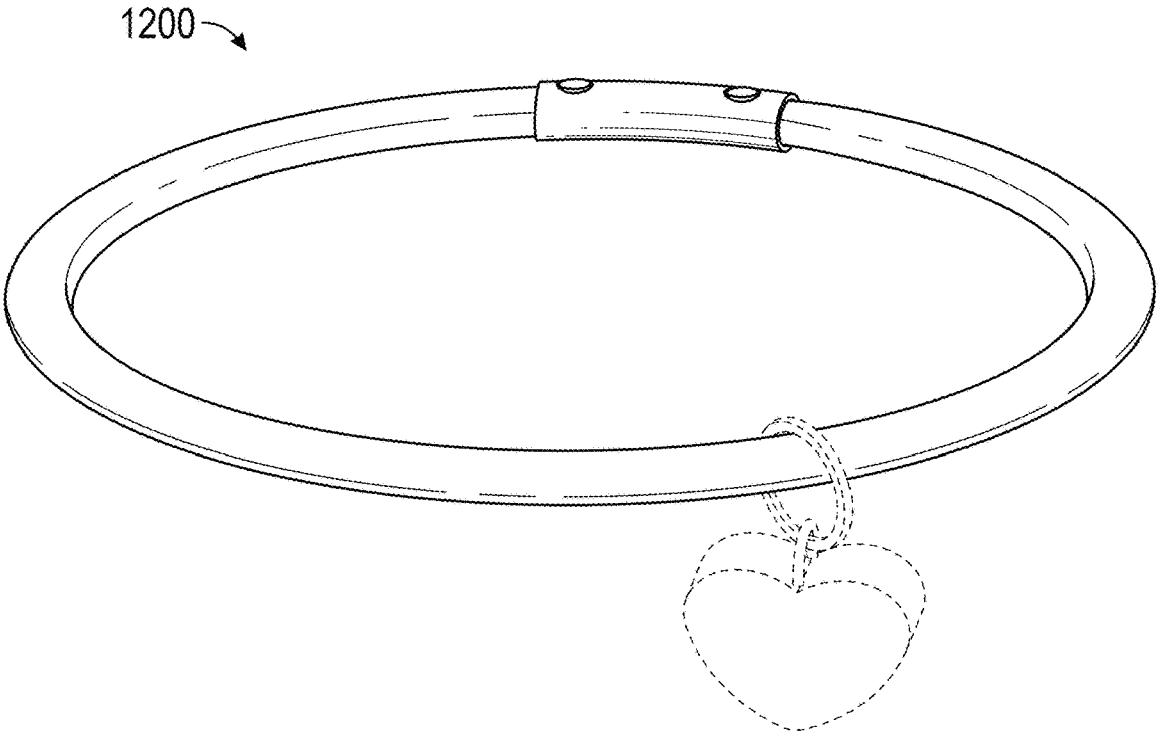

As shown in FIG. 11, a pin is inserted as described in connection with FIG. 8, and, as shown in FIG. 12, the pin 800 is then peened or crimped as described in connection with FIG. 9 thereby completing creation of the permanent bangle bracelet 1200.

Depending upon the particular implementation, in some implementations, the pins 800, if crimped, could be crimped sequentially, and with other implementations, the pins 800 could both be crimped concurrently with an appropriate tool.

Figure 13:
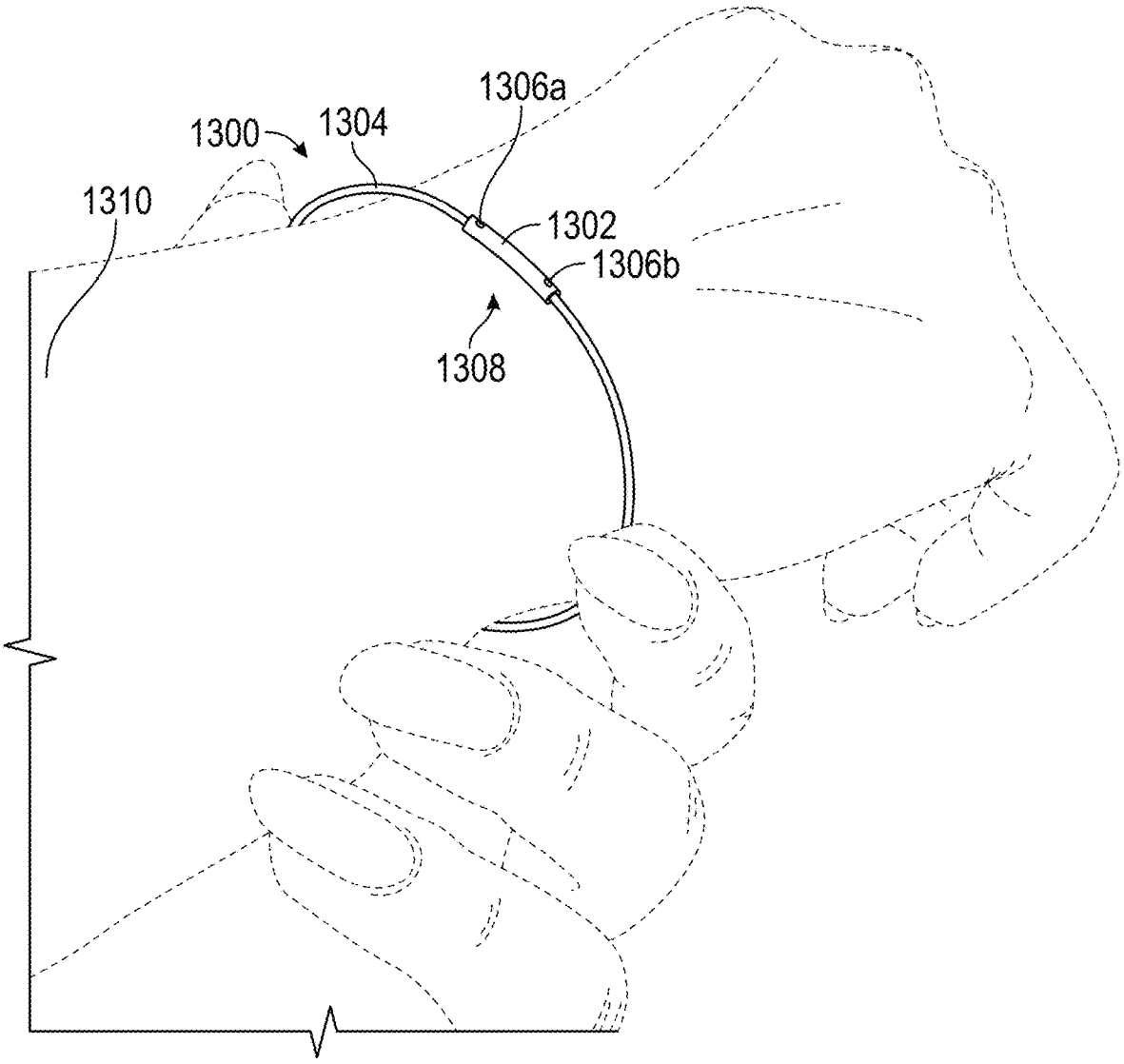
FIG. 13 illustrates, in simplified form, an example of a permanent bangle bracelet created according to the teachings herein.

FIG. 13 illustrates, in simplified form, an example of a permanent bangle bracelet 1300 created according to the teachings herein. Note that, as shown, the tube bar 1302 of FIG. 13 (and correspondingly the Band, in this example, a wire 1304, of the permanent bangle bracelet 1300), have their through holes placed so that the crimped pins 1306*a*, 1306*b* are essentially radial to the wrist 1308 of the wearer, as opposed to the permanent bracelet of FIG. 12, where the crimped pins 800 would be essentially longitudinally aligned with the arm 1310 of the wearer.

The process is essentially the same to create an wrist bracelet, ankle bracelet, necklace, choker or ring, the only difference being overall size and size of the components.

As should now be appreciated, advantageously, using the foregoing process, there is no need for any welding apparatus, and the process easily can be completed with minimal training and skill compared to micro welding.

Having described on example of the process for creating permanent jewelry, some representative different variants will now be described, with the understanding that a myriad of different variants can be created according to, and without deviating from, the teachings herein.

For example, advantageously, tube bars need not be plain, such as shown in FIGS. 2-6. Variant tube bars can themselves have different adornments.

For example, FIGS. 14-18 respectively illustrate, in simplified form, different views of a tube bar 1400 that includes one or more adornments 1402 raised above the surface 1404 of the tube bar 1400.

Figure 14:
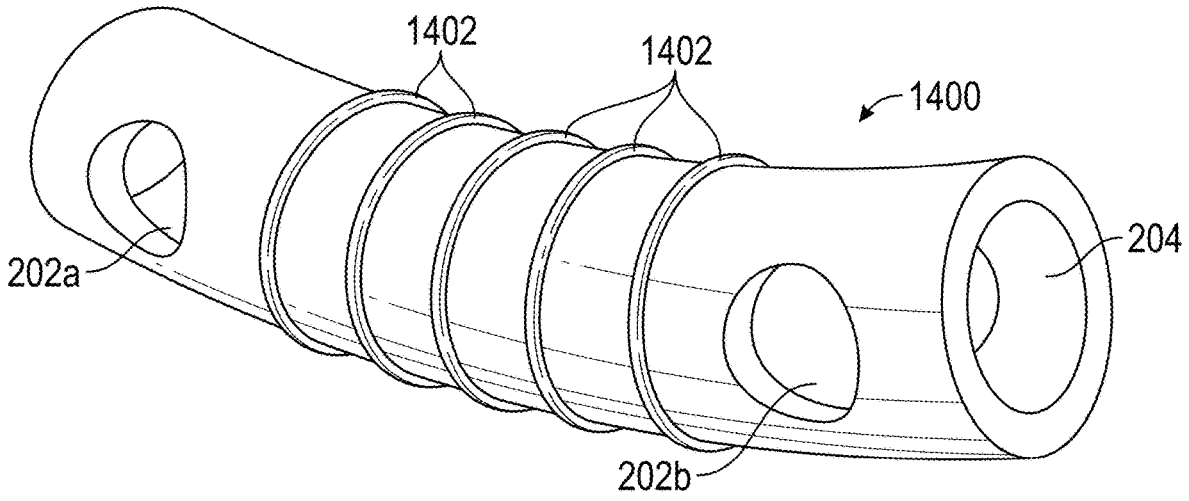
FIGS. 14-18 respectively illustrate, in simplified form, different views of a tube bar that includes one or more adornments raised above the surface of the tube bar.
Figure 15:
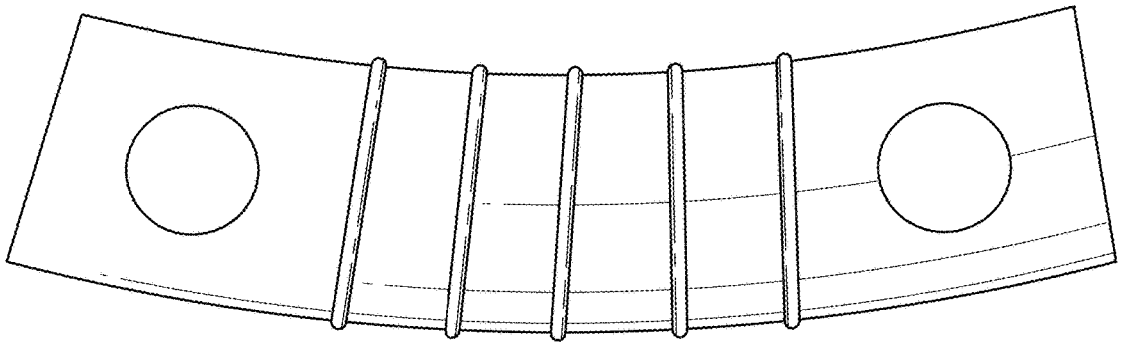
Figure 16:
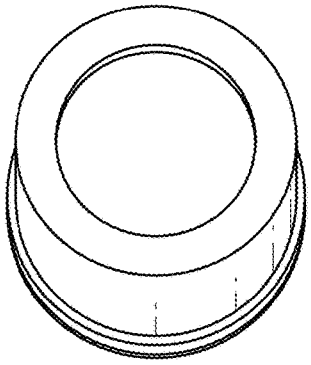
Figure 17:
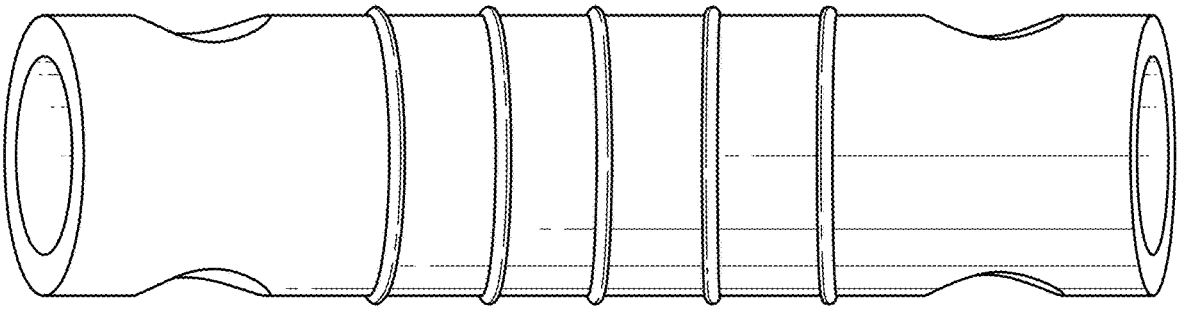
Figure 18:
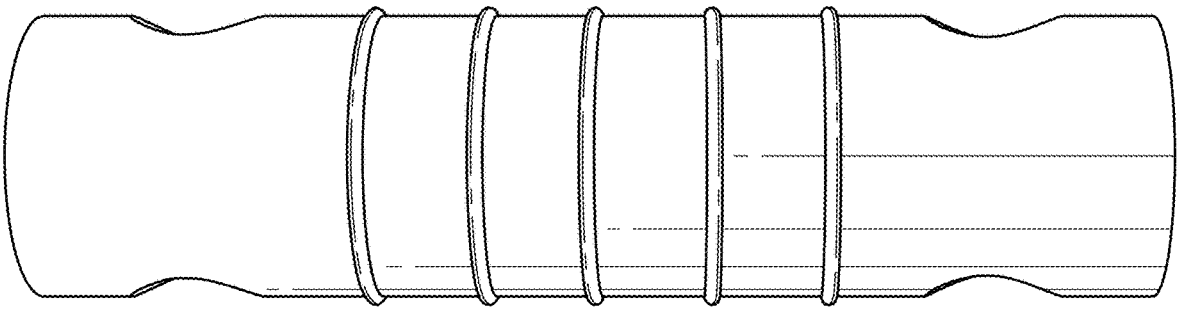

More particularly, FIG. 14 is a perspective view of this example type tube bar 1400, FIG. 15 is a top view of the tube bar 1400 of FIG. 14 (with bottom being a mirror image thereof), FIG. 16 is a right side view of the of the tube bar 1400 of FIG. 14 (with the left side being a mirror image thereof), FIG. 17 is a back view of the of the tube bar 1400 of FIG. 14, and FIG. 18 is a front view of the of the tube bar 1400 of FIG. 14. Although the adornments are shown as simple hoops, any of a myriad of adornments, raised above the surface 1404, can be created, in some cases simply resulting in a raised texture on the tube bar 1400.

Of course, adornments need not be raised above a surface of the tube bar. Advantageously, example adornments can be added into a surface of the tube bar as well.

FIGS. 19-24 respectively illustrate, in simplified form, different views of another tube bar 1900 that includes one or more adornments 1902 into (i.e., below) the surface 1404 of this tube bar 1900, for example, as shown, in the form of an engraved word.

Figure 19:
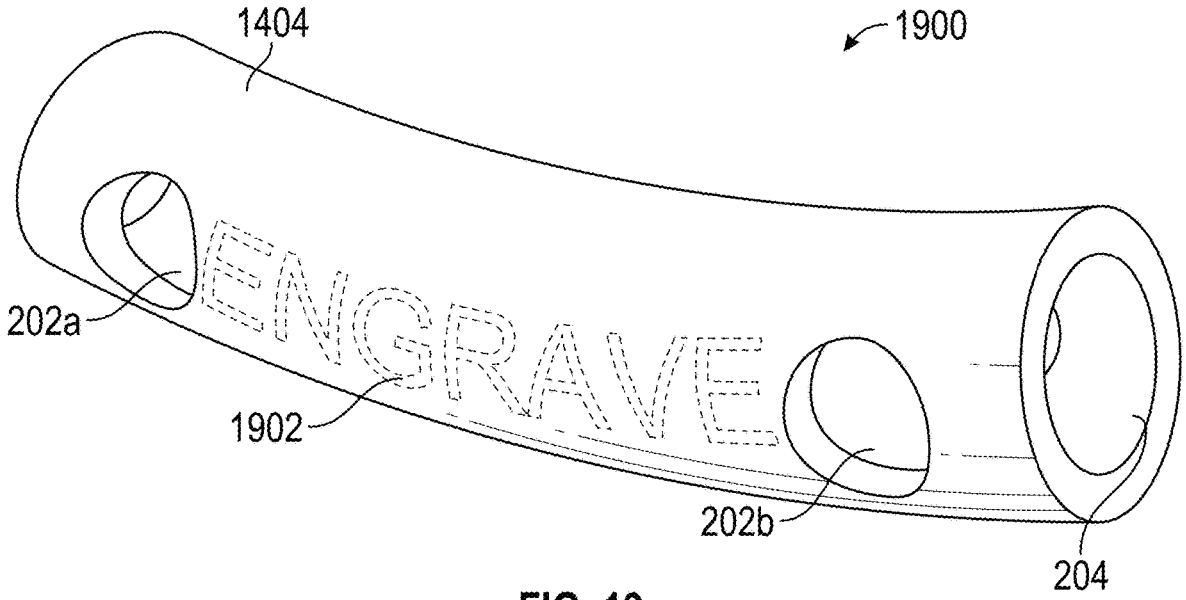
FIGS. 19-24 respectively illustrate, in simplified form, different views of another tube bar that includes one or more adornments into (i.e., below) the surface of this tube bar.
Figure 20:
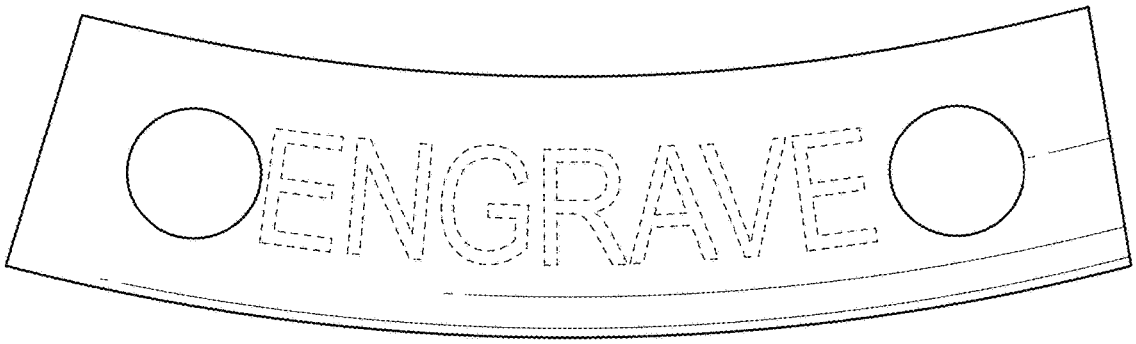
Figure 21:
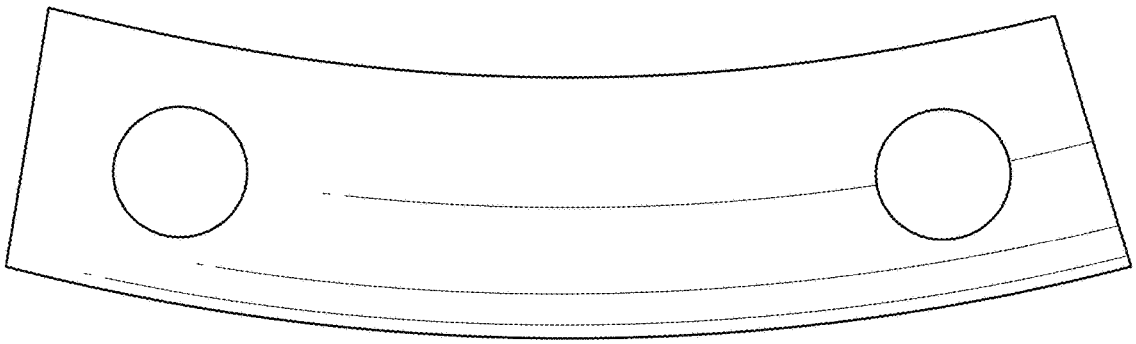
Figure 22:
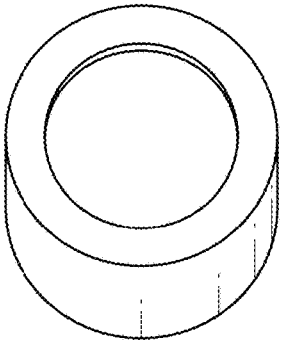
Figure 23:
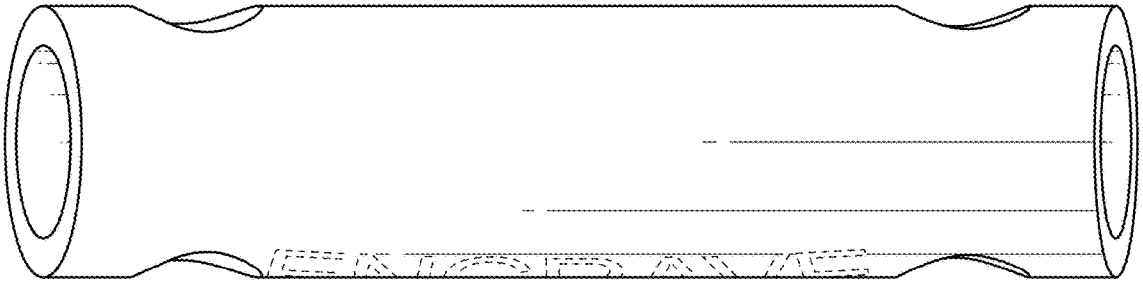
Figure 24:
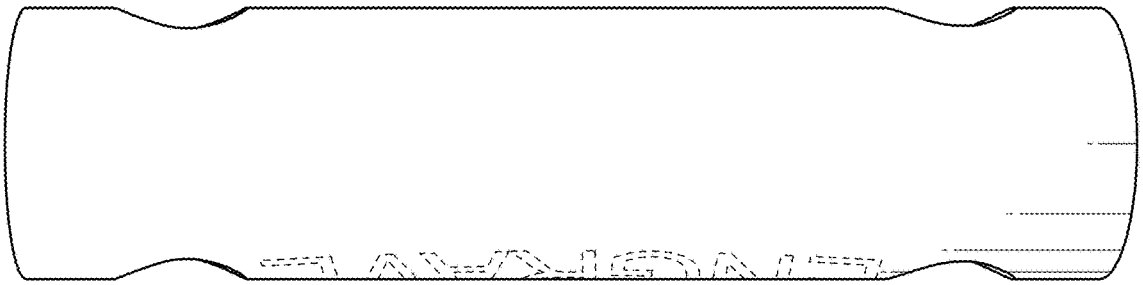

More particularly, FIG. 19 is a perspective view of this example tube tube bar 1900, FIG. 20 is a top view of the tube bar 1900 of FIG. 19, FIG. 21 is a bottom view of the tube bar 1900 of FIG. 19, FIG. 22 is a right side view of the of the tube bar 1900 of FIG. 19 (with the left side being a mirror image thereof), FIG. 23 is a back view of the of the tube bar 1900 of FIG. 19, and FIG. 24 is a front view of the of the tube bar 1900 of FIG. 19. Although the adornments are shown as letters, any of a myriad of adornments that are etched or engraved or otherwise recessed into the surface can be created, in some cases again resulting in a surface texture for the tube bar 1900.

FIGS. 25-32 illustrate, in simplified form, different views of yet another example of a type of tube bar 2500 containing one or more raised adornments 2502, in this case, one or more raised ring portions to which some other element, for example a charm, a chain, a pendant, etc., may be attached.

Figure 25:
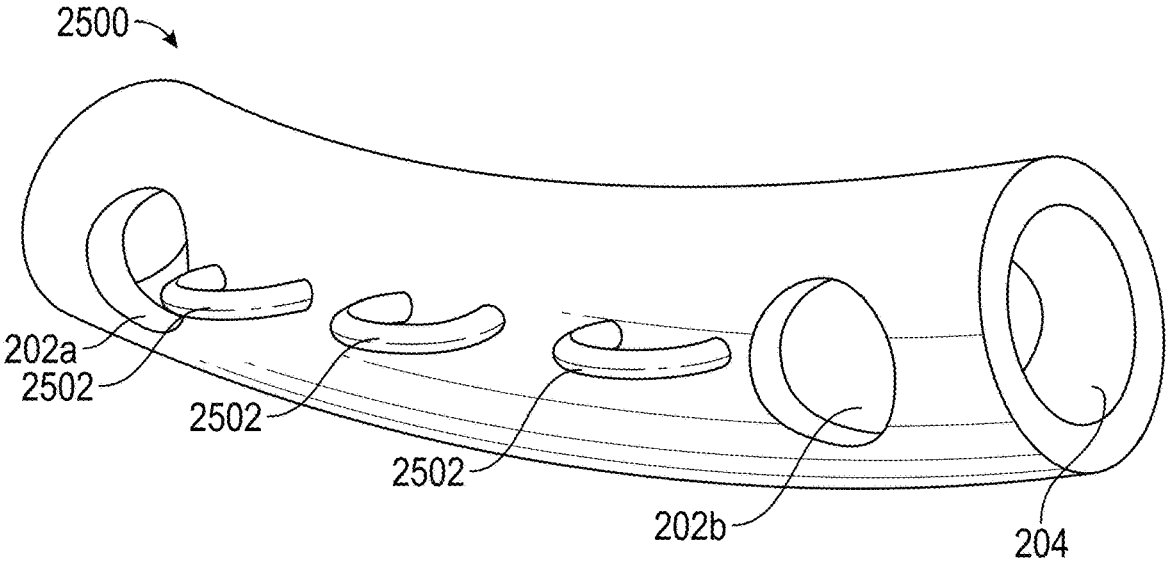
FIGS. 25-32 illustrate, in simplified form, different views of yet another example of a type of tube bar containing one or more raised adornments.
Figure 26:
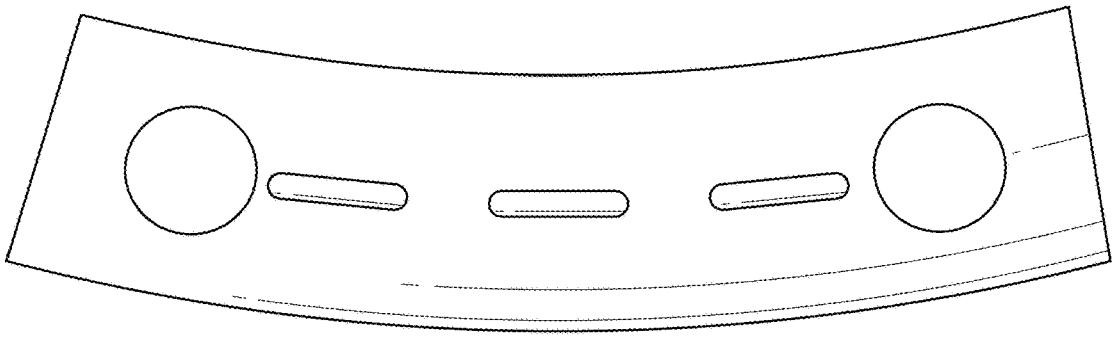
Figure 27:
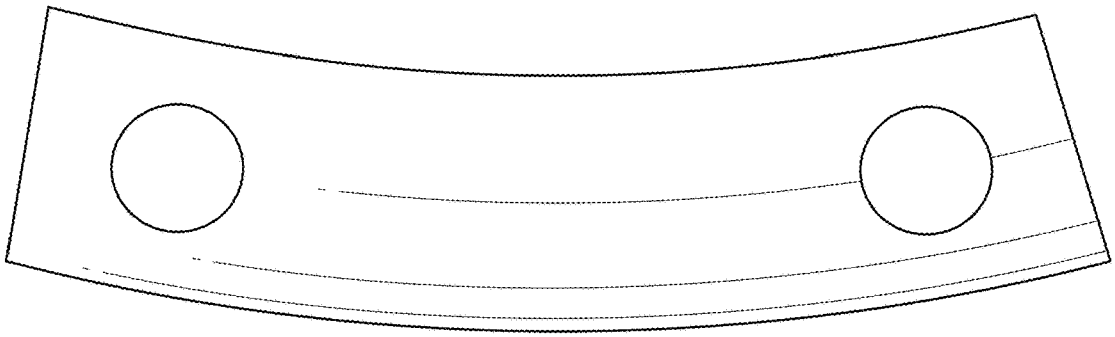
Figure 28:
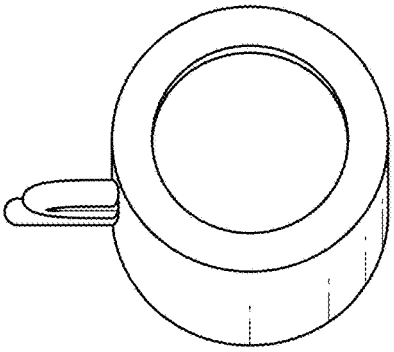
Figure 29:
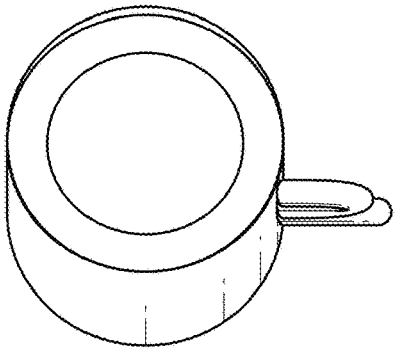
Figure 30:
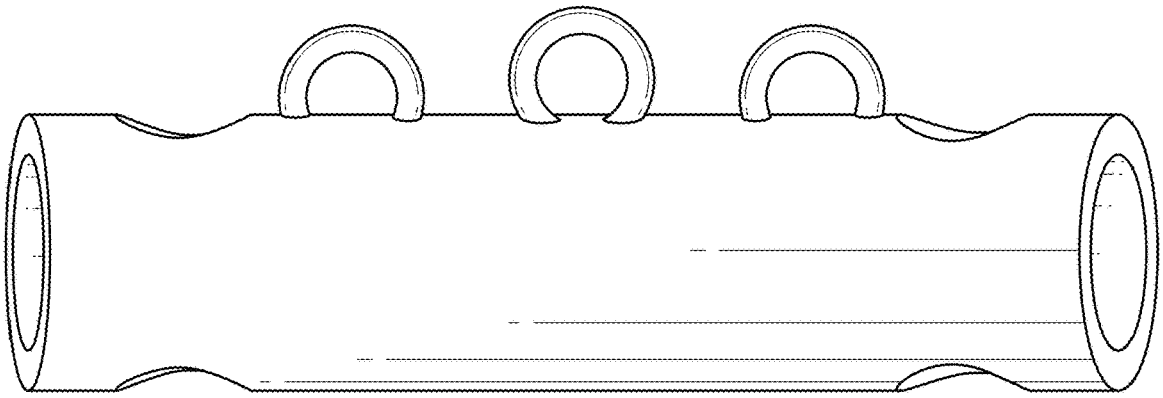
Figure 31:
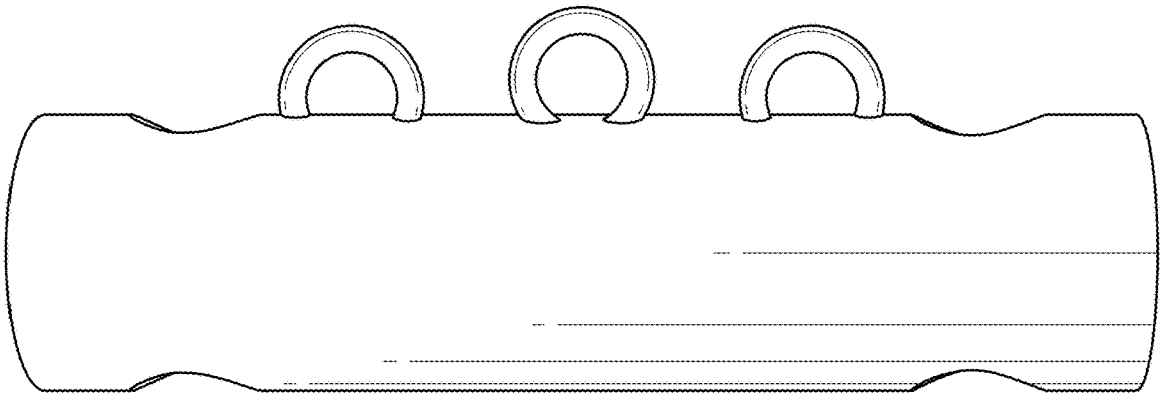
Figure 32:
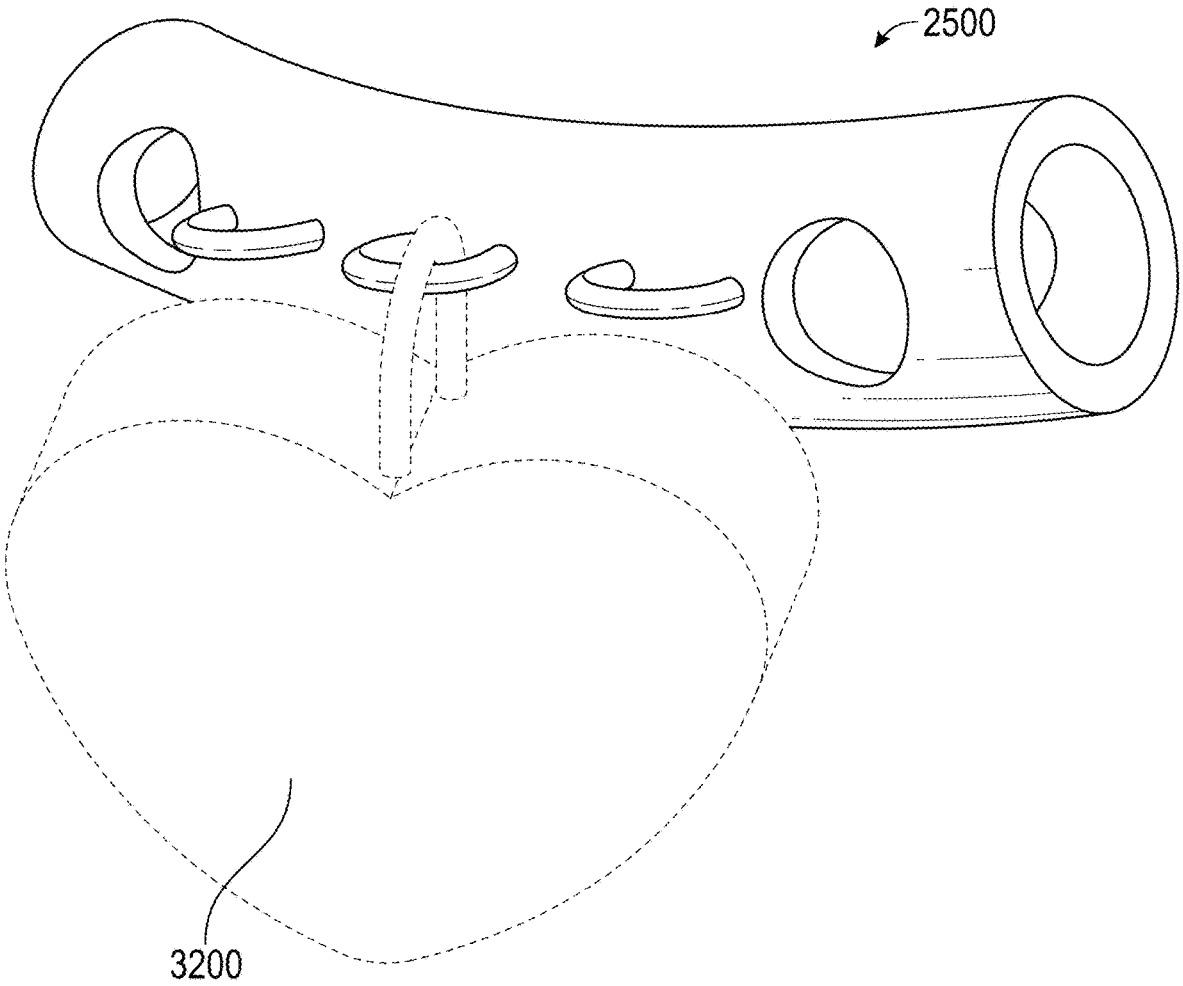

More particularly, FIG. 25 is a perspective view of this example tube bar 2500, FIG. 26 is a top view of the tube bar 2500 of FIG. 25, FIG. 27 is a bottom view of the tube bar 2500 of FIG. 25, FIG. 28 is a right side view of the of the tube bar 2500 of FIG. 25, FIG. 29 is a left side view of the of the tube bar 2500 of FIG. 25, FIG. 30 is a back view of the of the tube bar 2500 of FIG. 25, FIG. 31 is a front view of the of the tube bar 2500 of FIG. 25, and FIG. 32 is the perspective view of FIG. 25 showing how an example charm might be attached to the tube bar 2500.

Finally, it should be appreciated that adornments are not confined to being exclusively raised above, or recessed into, the surface 1404 of a tube bar. Adornments that are partially raised above and partially below the surface 1404 can also be present.

FIGS. 33-39 illustrate, in simplified form, different views of yet another example of a tube bar 3300 that includes adornments 3302, in the form of gemstones, that are partially above and partially below the surface 1404 of the tube bar 3300.

Figure 33:
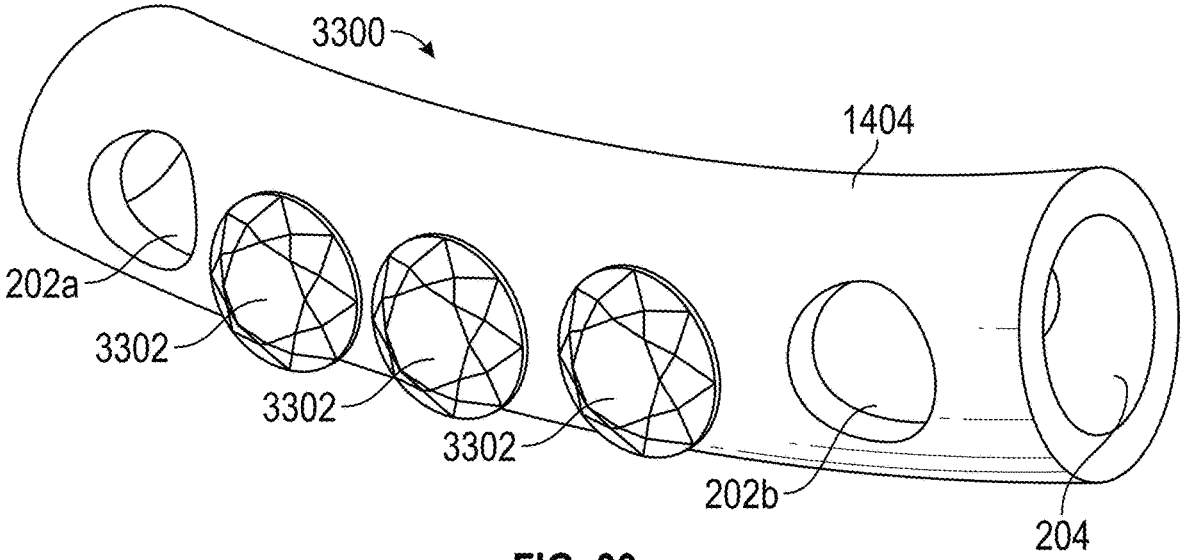
FIGS. 33-39 illustrate, in simplified form, different views of yet another example of a tube bar that includes adornments.
Figure 34:
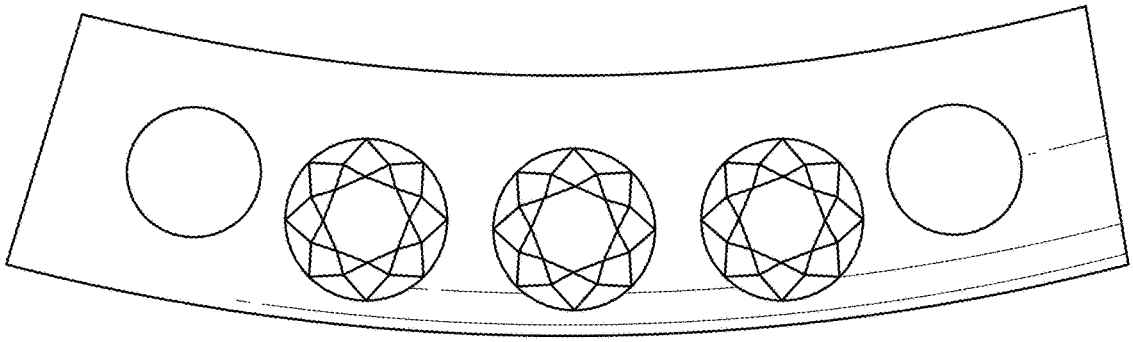
Figure 35:
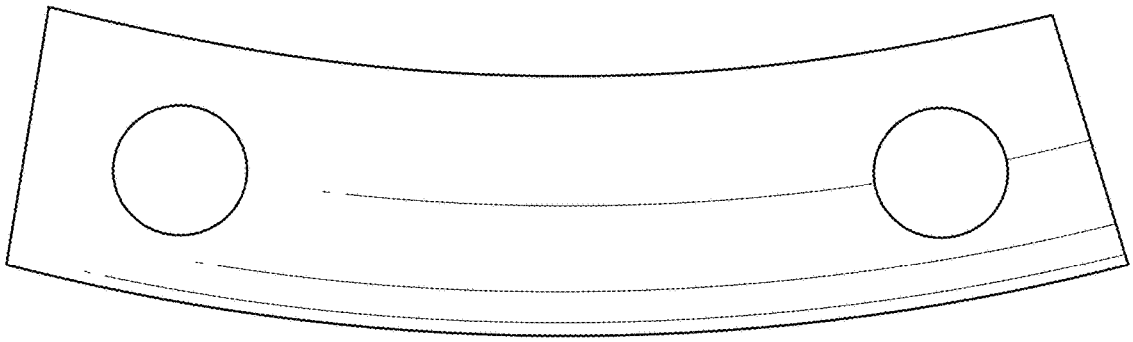
Figure 36:
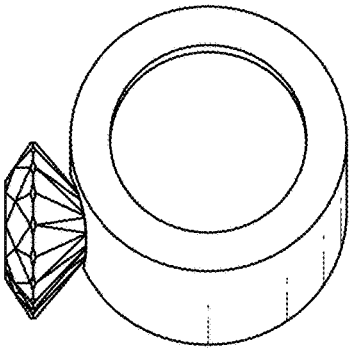
Figure 37:
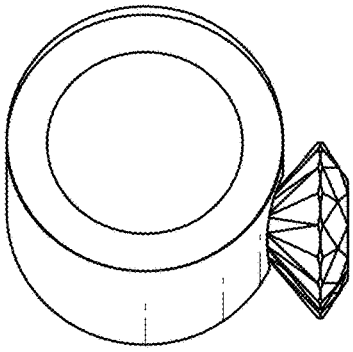
Figure 38:
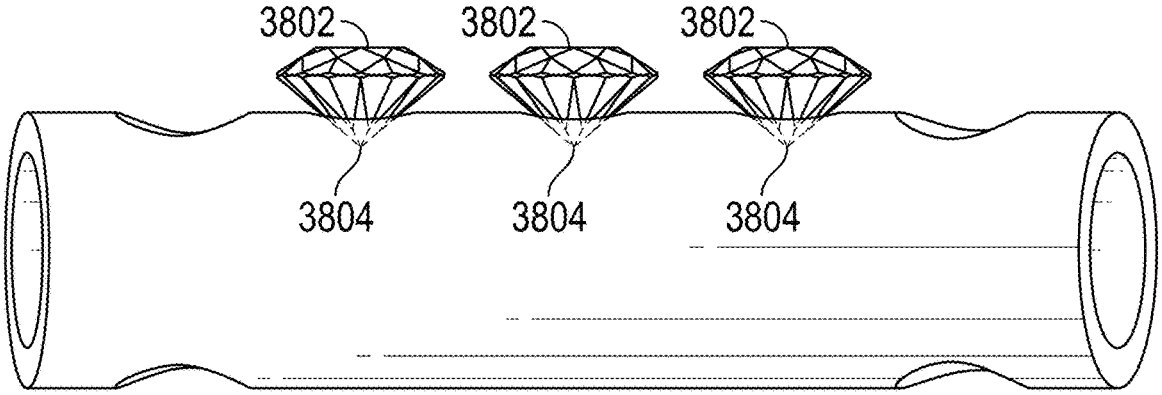
Figure 39:
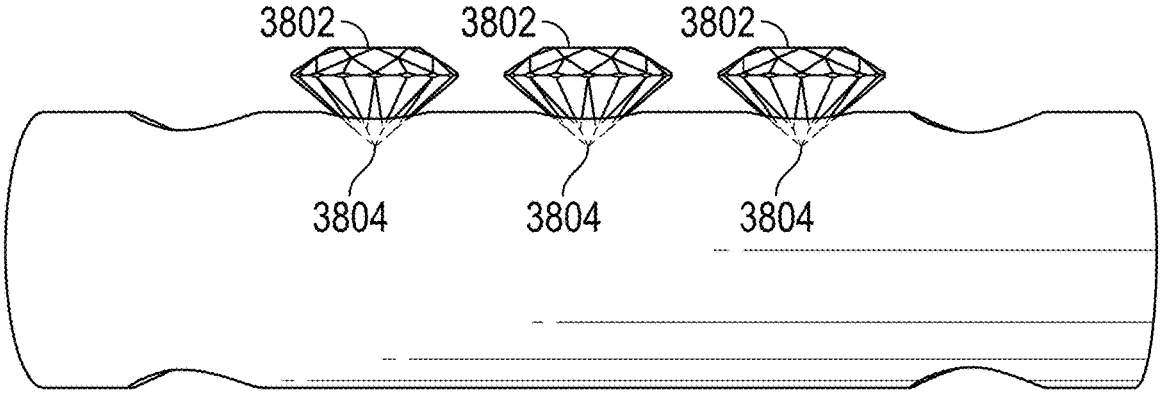

More particularly, FIG. 33 is a perspective view of this example type tube bar 3300, FIG. 34 is a top view of the tube bar 3300 of FIG. 33, FIG. 35 is a bottom view of the tube bar 3300 of FIG. 33, FIG. 36 is a right side view of the of the tube bar 3300 of FIG. 33, FIG. 37 is a left side view of the of the tube bar 3300 of FIG. 33, FIG. 38 is a back view of the of the tube bar 3300 of FIG. 33, and FIG. 39 is a front view of the of the tube bar 3300 of FIG. 33. As best illustrated in ghost lines in FIGS. 38-39, a portion 3802 of the gem stones 3302 are raised above the surface 1404, and another portion 3804 of the gem stones 3302 are below the surface 1404.

Up to now, the various examples shown have involved a tube bar into which a Band that forms a part of the permanent jewelry is inserted. However, the instant approach is not so limited. For example, in some cases, the permanent jewelry may be made using Band material that, in cross section is hollow (i.e., it is a tube), irrespective of whether the outer cross section is round, oval, square, rectangular, hexagonal or any other shape, and whatever the cross section of the hollow is. Advantageously, a reverse version the approach described above can be used with such a Band as well and, even more advantageously, can help ensure proper alignment between the ends to be joined.

Figure 40:
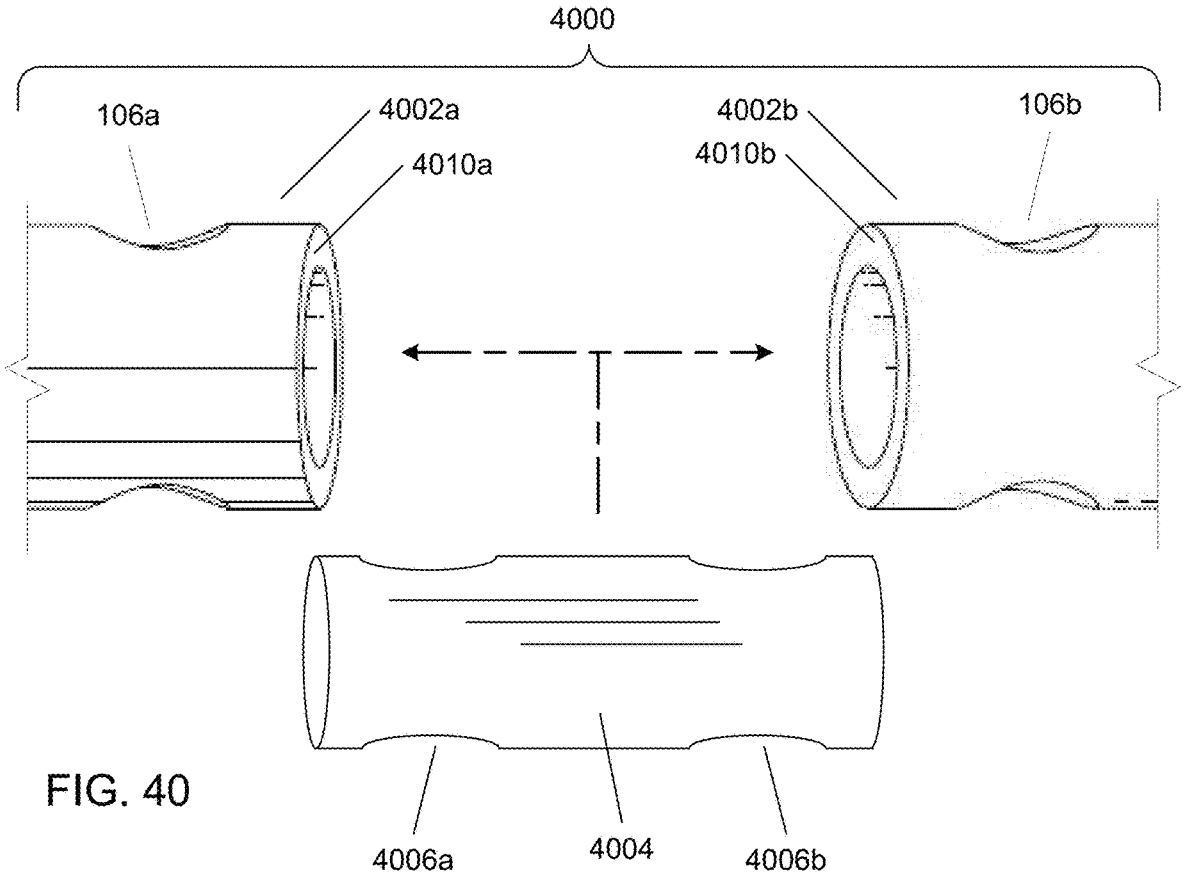
FIG. 40 illustrates, in simplified form, one example 4000 illustrating a reverse version for creating an item of permanent jewelry according to the teachings herein.

FIG. 40 illustrates, in simplified form, one example 4000 illustrating a reverse version for creating an item of permanent jewelry according to the teachings herein. As shown in FIG. 40, there are two ends 4002*a*, 4002*b* of the Band, in this example, hollow wire or bar stock (only a portion of which is shown), to be joined to form an article of permanent jewelry (which, as shown for simplicity, is round, but could be of other shaped cross sections as noted above). In accordance with the foregoing teachings, each end of the Band has through holes 106*a*, 106*b* therein. An internal bar 4004 having through holes 4006*a*, 4006*b* (of the same size as the through holes 106*a*, 106*b*) is provided whose maximum outer dimension, in the largest direction, is slightly less than the hollow portion 4008*a*, 4008*b* of the ends 4002*a*, 4002*b* of the wire or stock, such that it can slide into the hollow portions 4008*a*, 4008*b* of the ends 4002*a*, 4002*b*. The internal bar 4004 is constructed such that, when the terminal surfaces 4010*a*, 4010*b* of the ends 4002*a*, 4002*b* of the Band abut, the respective through hole pairs 106*a*, 4006*a*, 106*b*, 4006*b* are aligned such that a pin 800 (not shown) in this view can be inserted therein and peened or crimped to thereby join the two ends 4002*a*, 4002*b* in proper alignment and without any of the type of marring that would arise from micro welding.

Figure 41:
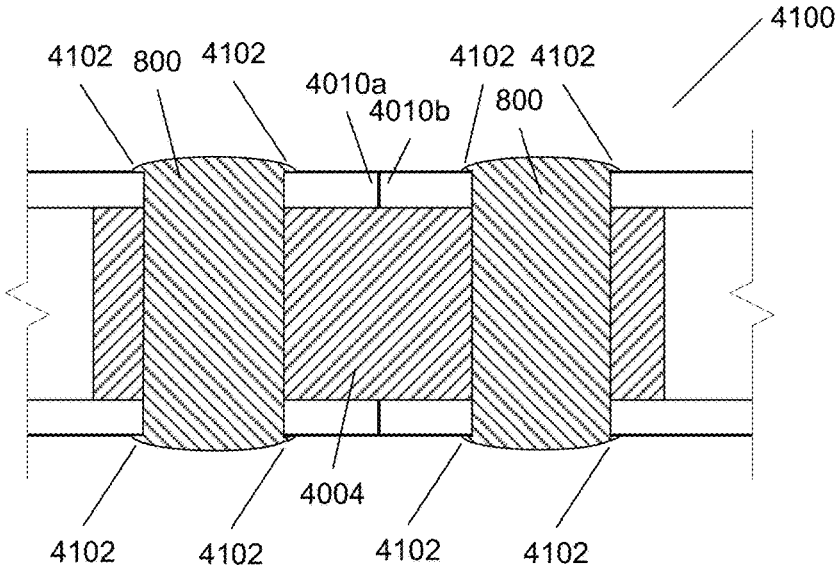
FIG. 41 illustrates, in simplified form a cross section of the ends in FIG. 40 after they have been joined.

FIG. 41 illustrates, in simplified form a magnified longitudinal cross section 4100 of the ends 4002*a*, 4002*b* of FIG. 40 through the pin center axis after the ends 4002*a*, 4002*b* of FIG. 40 have been joined. As can be seen in this view, the criping/peening as described above caused the pin ends to expand 4102 beyond the edges of the outer through holes 106*a*, 106*b* and thereby prevent the pin 800 from sliding out.

Up until now, all of the examples have involved tube bars having two through holes for pins. However, some implementations can readily be constructed that only require the tube bar to have one through hole.

FIG. 42 illustrates, in simplified form, an example implementation involving a tube bar that only includes one through hole.

As shown in FIG. 42, there is portion 4200 of a Band that will form an item of permanent jewelry and a tube bar 4202 similar to what has been previously described (i.e., the tube bar 4202 could be plain, include adornments, be curved or straight). However, unlike the previous tube bars, this tube bar only has one through hole 4204, which will be used to join the portion 4200 of the Band to another portion of the intended permanent jewelry item.

In contrast to most of the previous examples, this tube bar 4202 has been joined to the portion 4200 while not on the intended wearer. As such, with this example implementation, the tube bar is partially joined at one end 4206 to a terminal end of the portion 4200 by a joint 4208, using a known soldering technique or through micro welding, since, not being on the intended wearer, its entirety is readily accessible. Thus, for example, this process could be performed in a jewelry manufacturing facility or jewelry store well prior to selection by any intended wearer (optionally including sufficient excess length of wire/stock that can be cut down for a potential wearer (assuming the capability to add an appropriate through hole thereafter)). Of course, a potential disadvantage of such an approach is that, in cases where the joint 4208 has been previously made, the process may eliminate the possibility of an intended wearer opting for a different combination of Band and tube bar. Of course, in other cases, the intended wearer could individually select the two (i.e., Band and tube bar), and then, thereafter, they would be joined remote from the intended wearer and, later, once completed, the other end of the Band could be affixed to while on the intended wearer to complete the item of permanent jewelry using the through hole and pin approach described above.

As noted above, advantageously the tube bar between the two through holes, or through hole and opposite end if of the type shown in FIG. 42, is not limited to any particular shape. For example, FIG. 43A illustrates, in simplified form an alternative example tube bar 4300*a* that has ends 4302*a*, 4302*b* that are similar to those previously described, including internal orifices 4304 to accommodate the Band and through holes 202*a*, 202*b* to accommodate pins (not shown), however, as shown the body 4306*a* of the tube bar 4300*a* between the two through holes 202*a*, 202*b* has a large shape and incorporates an adornment 4308, as shown, a single jewel.

FIG. 43B illustrates, in simplified form another alternative example tube bar 4300*b* similar to that of FIG. 43A except that it has a body 4306*b* of a different shape and a different adornment 4308*b* in the form of an enamel filled surface engraving.

FIG. 43C illustrates, in simplified form yet another alternative example tube bar 4300*c*, similar to that of FIG. 43A, except that it has a body 4306*c* of another different shape, in this case, two pieces of hollow square bar stock joined at an angle (which could be any angle).

Thus, from FIGS. 43A-43C, it should be understood and appreciated that the tube bar can be of any of a myriad of different overall shapes, including, for example, letter(s), number(s) symbol(s) or any combination thereof, the particular overall shape of the body between within the through holes being purely a matter of design choice.

FIG. 44 illustrates, in simplified form, another example implementation of an item of permanent jewelry 4400 that can be created by applying the teachings herein using a variant the foregoing. As shown, this permanent jewelry 4400 is circular and made up of multiple segments 4402*a*, 4402*b*, 4402*c* of Band coupled together using multiple tube bars 4404*a*, 4404*b*, 4404*c*. As such, the Band segments can be of similar or different materials and/or different colors/textures of the same material, for example, as shown, one segment 4402*a* could be yellow gold, another segment 4402*b* could be white gold and the third segment 4402*c* could be grey gold or spangold, with same being true for the tube bars 4404*a*, 4404*b*, 4404*c*. Similarly, one of he segments 4202*a* could be chain, whereas another 4202*b* could be wire and the third, 4202*c* could be either of the foregoing. Thus, using multiple segments allows for tremendous design flexibility, not as readily possible for conventional permanent jewelry.

Figure 45:
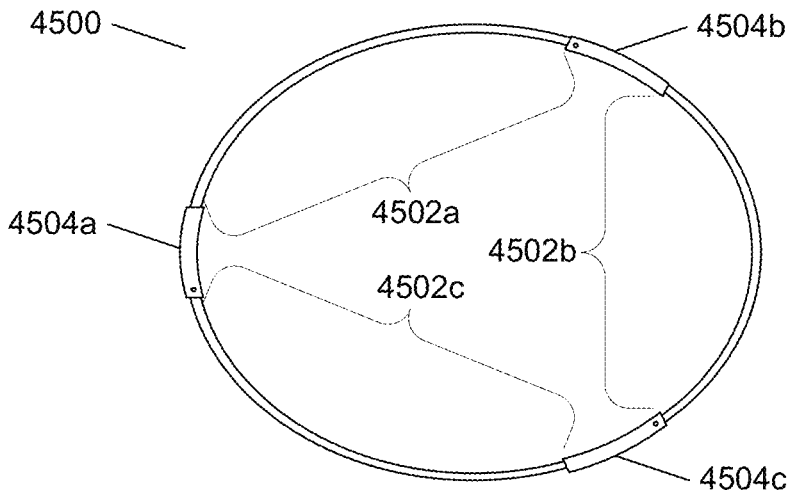
FIG. 45 illustrates, in simplified form, yet another example implementation of an item of permanent jewelry that can be created by applying the teachings herein.

FIG. 45 illustrates, in simplified form, yet another example implementation of an item of permanent jewelry 4500 that can be created by applying the teachings herein using a variant the foregoing, in this case, the single pin tube approach of FIG. 42. As shown in FIG. 45, multiple segments 4502*a*, 4502*b*, 4502*c* of a Band are joined using tube bars 4504*a*, 4504*b*, 4504*c* having different radii of curvature, to create an oval shaped item of permanent jewelry 4500.

Figure 46A:
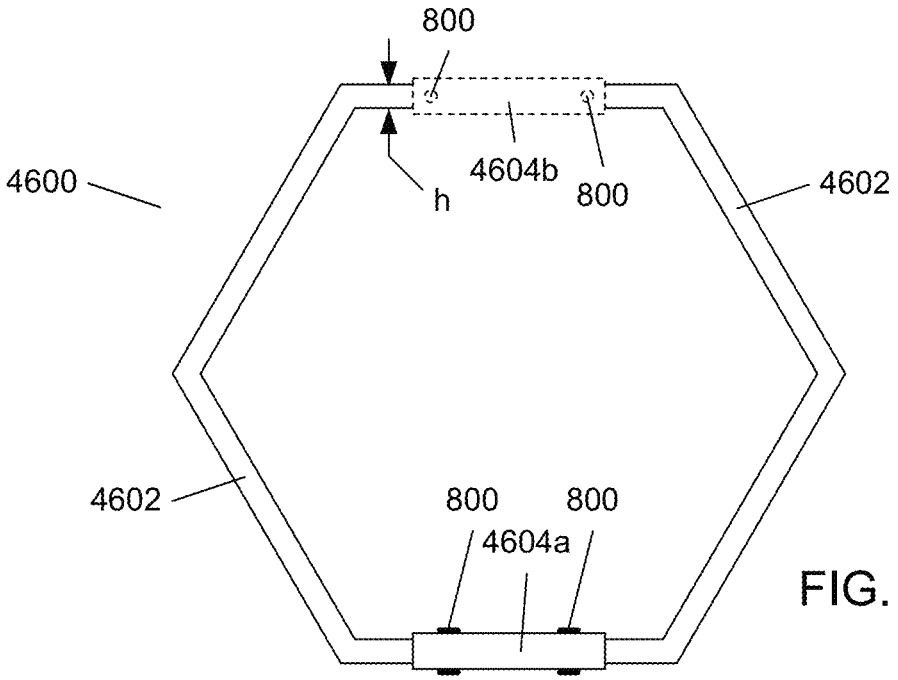
FIG. 46A illustrates, in simplified form, a top view of another example implementation of an item of permanent jewelry 4600 that can be created using a variant the foregoing.
Figure 46B:
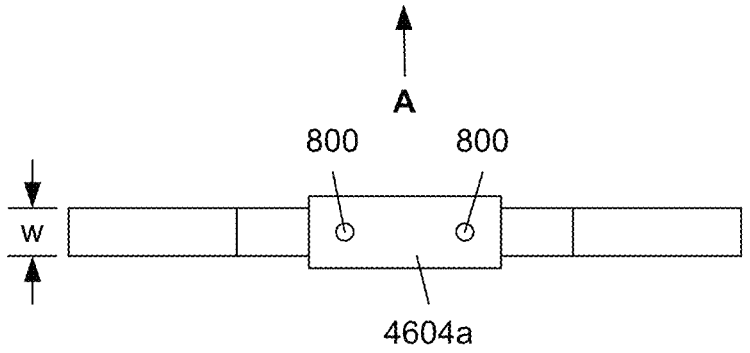
FIG. 46B illustrates, in simplified form, a side view of the item of permanent jewelry of FIG. 46A.

FIG. 46A illustrates, in simplified form, a top view of another example implementation of an item of permanent jewelry 4600 that can be created using a variant the foregoing. FIG. 46B illustrates, in simplified form, a side view of the item of permanent jewelry 4600 of FIG. 46A viewed from the direction shown by the arrow A in FIG. 46A.

As shown in FIGS. 46A-46B, this permanent jewelry 4600 is made from a Band involving rectangular stock 4602 (solid or hollow) having a height ("h") that is smaller than its width ("w") fashioned in the shape of a hexagon. As shown, at least one correspondingly rectangular tube bar 4604*a* is used to join ends of the Band 4602 to form this permanent jewelry 4600 using pins 800 as described previously. Optionally, for certain shapes, for example to avoid deforming them, it will be desirable to use more than one tube bar 4604*b* (as shown using ghost lines).

Moreover, as evident by comparing the two tube bars 4604*a*, 4604*b* in FIGS. 46A-46B, it should again be reinforced and appreciated that the direction of the pins 800 can be oriented such that they will be oriented outward from the portion of the wearer's body where the permanent jewelry will be affixed, or, alternatively, along the portion of the wearer's body where the permanent jewelry will be affixed, or, even along some other orientation, the particular orientation being a matter of design choice.

Bands of the chain type can, in some cases, present issues that differentiate them in some respects from other types of Band material. Advantageously, through a slight modification, the foregoing pin-joinder approaches can still be used.

Figure 47:
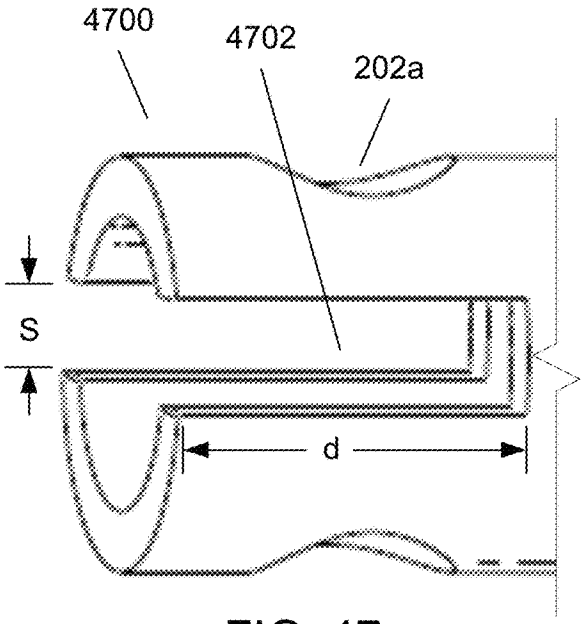
FIG. 47 illustrates, in simplified form, an additional example variant implementation of a tube bar (only a portion of which is shown) suitable for use with a chain-type Band.

FIG. 47 illustrates, in simplified form, an additional example variant implementation of a tube bar 4700 (only a portion of which is shown) suitable for use with a chain-type Band. As shown, the tube bar 4700 includes a through hole 202*a* as discussed previously, but also includes a slot 4702 in a plane perpendicular to the longitudinal direction of the through hole 202*a*. The slot 4702 has a spacing "S" of an extent suitable to allow a link of a chain to pass into the tube bar 4700 and a depth "d" that will enable a pin 800 inserted through the through hole 202*a* to lock the chain to the tube bar 4700.

Figure 48:
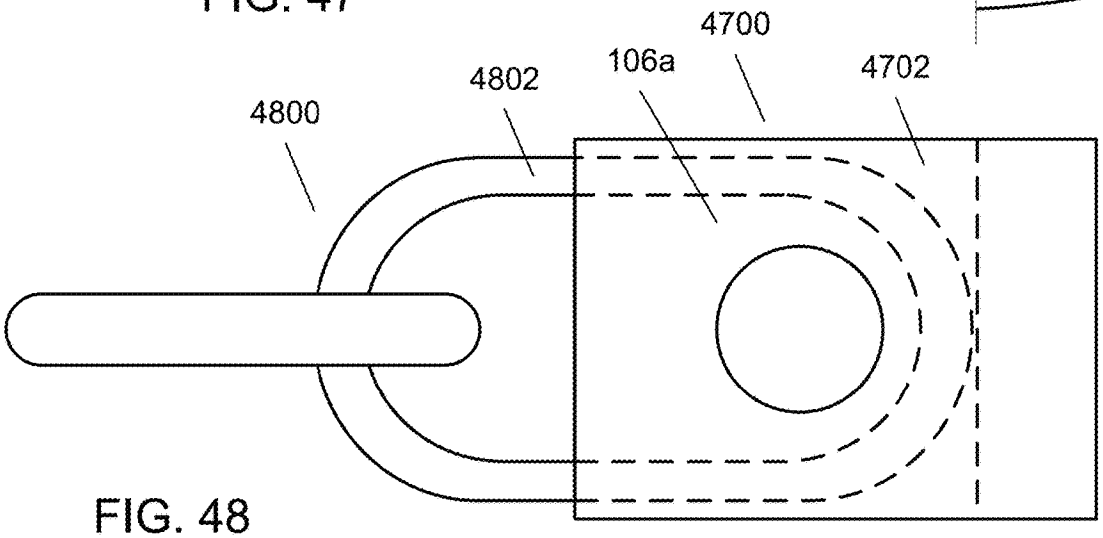
FIG. 48 illustrates, in simplified form, a top view of one representative example of how a chain-type Band can be attached to a tube bar.

FIG. 48 illustrates, in simplified form, a top view of one representative example of how a chain-type Band 4800 can be attached to a tube bar 4700 as part of the process or forming an item of permanent jewelry. In this example, the Band 4800 is a fine chain such that, when a terminal link 4802 of the chain 4800 inserted into the slot 4702 tube bar 4700, the through hole 106*a* of the Band 4700 is the open portion within the link 4802. As a result, a pin (not shown) inserted into the through hole 202*a* and peened or crimped as described above will lock the link of the Band 4800 within the tube bar 4700.

Figure 49:
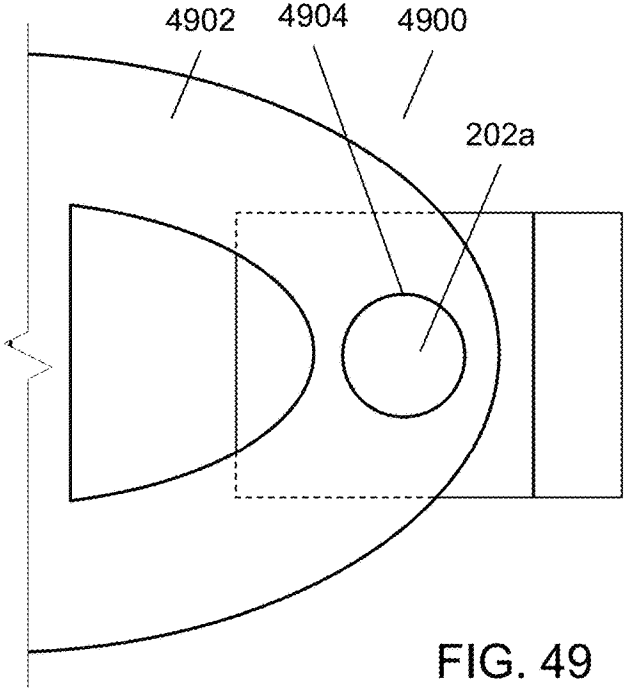
FIG. 49 illustrates, in simplified form, a top view of another representative example of how a chain-type Band can be attached to a tube bar.

FIG. 49 illustrates, in simplified form, a top view of another representative example of how a chain-type Band can be attached to a tube bar as part of the process or forming an item of permanent jewelry. In this example, the Band 4900 (only one link 4902 of which is shown) has larger chain links, so it is possible to take a terminal link 4902 and incorporate a through hole 4904 in the terminal link 4902 (which will serve as the Band through hole 106*a*) whose diameter corresponds to that of the through hole 202*a* of the tube bar 4700. As a result, a pin 800 (not shown) inserted into the through hole 202*a* and peened or crimped as described above will similarly lock the link 4902 of the Band 4900 within the tube bar 4700.

Despite the foregoing, in some cases, the approach of FIGS. 48-49 may not be feasible, either because of the size of the slot 4702 that would be required for a particular chain-type Band, or because of the specific links making up the Band, particularly the terminal link of the Band. Nevertheless, the approach can still be used through implementations similar to the one which will now be described in connection with FIG. 50.

Figure 50:
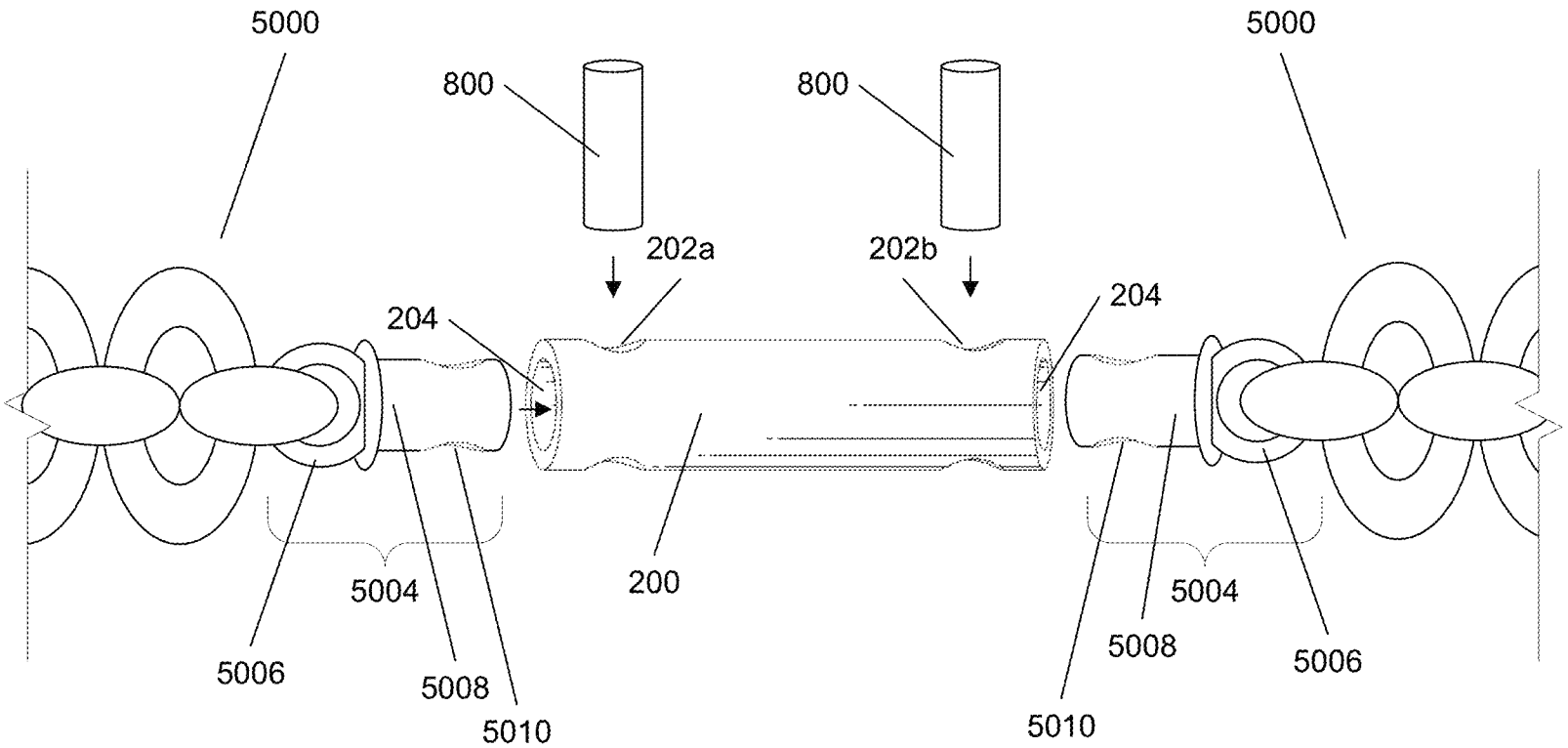
FIG. 50 illustrates, in simplified form, a representative example of an implementation variant that can be used in circumstances where the tube bar of FIG. 47 can't be used for a chain type Band.

FIG. 50 illustrates, in simplified form, a representative example of an implementation variant that can be used in circumstances where the tube bar 4700 of FIG. 47 can't be used for a chain type Band. Nevertheless, as will be seen, tube bars as previously described can be used.

As shown, by way of example, a plain tube bar 200 as discussed above can be used with this example implementation. However, due to the type of links of the Band 5000, in order to attach the Band 5000 to the tube bar 200, a terminal link 5002 of the Band will get attached to an adapter bar 5004 made up of a jump ring 5006 and a plug 5008, sized to fit into the cavity 204 of the tube bar 200, with the plug 2008 having a through hole 5010 that corresponds to the through hole 202*a*, 202*b* of the tube bar 200. The jump ring 5006 is used to connect the terminal link 5002 to the plug 5004.

As a result, to attach the Band 5000 to the tube bar 200, the plug 5004 is inserted into the cavity 204 with the through holes 202*a*, 5010 aligned. Once that is done, a pin 800 is inserted through the aligned through holes 202*a*, 5010 and crimped/peened as described above.

Should the need arise to remove an item of permanent jewelry constructed according to the teachings herein from a person (for example, for a temporary medical reason or otherwise), this can advantageously be accomplished by simply removing one end of a connecting pin and sliding the pin out via the other end. In this way, there is no need to damage the tube or Band to do so. Moreover, thereafter, the item of permanent jewelry can be re-attached simply through use of a new pin.

As should now be appreciated, some variants applying the teachings herein allows for the creation of items of permanent jewelry that can eliminate the need for micro welding.

Applying the teachings herein with other variants allows for the creation of items of permanent jewelry that involve Bands of heavier material than can be created according to conventional methods.

Applying the teachings herein can avoid or minimize the need for special skill or training in order to create items of permanent jewelry.

Moreover, the teachings, components and processes herein are scalable in size such that they can be used to create small items of permanent jewelry, like rings, larger items of permanent jewelry, like bracelets, anklets or bangles, or even larger items of permanent jewelry like necklaces using essentially the same approaches and types of components.

Applying the teachings herein thus can make it possible to create items of permanent jewelry that could not be created at all using conventional micro welding approaches.

Some variants applying the teachings herein can ensure perfect alignment between two ends of a Band.

The foregoing outlines, generally, the features and technical advantages of one or more implementations that can be constructed based upon the teachings in this disclosure in order that the following detailed description may be better understood. However, the advantages and features described herein are only a few of the many advantages and features available from representative examples of possible variant implementations and are presented only to assist in understanding. It should be understood that they are not to be considered limitations on the invention as defined by the appended claims, or limitations on equivalents to the claims. For instance, some of the advantages or aspects of different variants are mutually contradictory, in that they cannot be simultaneously present in a single embodiment. Similarly, some features or advantages may be applicable to one aspect and inapplicable to others. Thus, the foregoing features and advantages should not be considered dispositive in determining equivalence. Additional features and advantages, although not detailed herein, will be apparent from the teachings of the description, drawings, and claims.

What is claimed is:

1. An item of permanent jewelry comprising:

a Band including a first terminal end and a second terminal end, wherein the first terminal end of the Band includes a first hollow extending longitudinally into the first terminal end, and a first through hole extending transversely through the Band and the first hollow;

an internal bar having a first terminal end and a second terminal end, wherein the first terminal end of the internal bar includes a first through hole extending transversely therethrough;

wherein the internal bar is inserted into the Band such that the first terminal end of the internal bar is within the first terminal end of the Band and the respective first through holes of the internal bar and the Band are aligned so as to form a first passage extending from a first exterior side of the Band through the internal bar to a second exterior side of the Band opposite the first exterior side;

a first pin within at least the first passage, the pin extending through the aligned first through holes of both the Band and internal bar, wherein the first pin is compressed on both sides of the aligned through holes such that the first pin cannot slide out of the aligned first through holes; and wherein the second terminal end of the Band is coupled to the internal bar such that, when joined and on a wearer, a closed loop involving the Band and the internal bar is formed such that the closed loop cannot be removed by the wearer without damaging at least one of the Band, the internal bar or the first pin.

2. The item of permanent jewelry of claim 1 wherein:

the second terminal end of the Band includes a second hollow extending longitudinally into the second terminal end, and a second through hole extending transversely through the Band and the second hollow; and wherein the second terminal end of the internal bar includes a second through hole extending transversely therethrough;

wherein the second terminal end of the internal bar is within the second terminal end of the Band and the respective second through holes of the internal bar and the Band are aligned so as to form a second passage extending from a second exterior side of the Band through the internal bar to a second exterior side of the Band opposite the second exterior side; and a second pin within at least the second passage, the second pin extending through the aligned second through holes of both the Band and internal bar, wherein the second pin is compressed on both sides of the aligned through holes such that the second pin cannot slide out of the aligned second through holes; and the second terminal end of the Band is further coupled to the second terminal end of the internal bar such that, when joined and on a wearer, the closed loop cannot be removed by the wearer without damaging at least one of the Band, the internal bar or the second pin.

3. The item of permanent jewelry of claim 1 wherein the Band comprises at least two segments.

4. The item of permanent jewelry of claim 1 wherein the Band comprises a precious metal.

5. The item of permanent jewelry of claim 4 wherein the internal bar comprises a precious metal.

6. The item of permanent jewelry of claim 1 further comprising at least one adornment on the Band.

7. An item of permanent jewelry comprising:

a Band including a hollow extending longitudinally into the Band from a first terminal end, the hollow being entirely defined by a surface of the Band;

an internal bar having a first terminal end;

the Band surface defining the hollow being dimensioned to fully surround the first terminal end of the internal bar inserted into the hollow;

wherein the Band is connected to the internal bar by at least one pin extending transversely through both the first terminal end of the Band and the first terminal end of the internal bar; and wherein a second terminal end of the Band and a second terminal end of the internal bar are coupled together such se that the Band and internal bar collectively form a closed loop about a part of a person of a size such that the closed loop cannot be slid off the person without damaging at least one of the Band, the internal bar or the at least one pin.

8. The item of permanent jewelry of claim 7 wherein the Band comprises at least two segments.

9. The item of permanent jewelry of claim 7 wherein the Band comprises a precious metal.

10. The item of permanent jewelry of claim 9 wherein the internal bar comprises a precious metal.

11. A method of forming an item of permanent jewelry on a person, the method comprising:

a) coupling a first end of a Band to an internal bar;

b) placing the Band about a portion of the person;

c) coupling a second end of the Band to the internal bar using a pin so as to form a closed loop about the portion; and d) compressing the pin so that the pin cannot slide out of the internal bar.

12. The method of claim 11, wherein step "b)" occurs before step "a)" in time.

13. The method of claim 11 further comprising:

prior to step "c)" attaching at least one adornment to the Band.

14. The method of claim 10 wherein the compressing in step "d)" comprises at least one of: (i) crimping the pin using parallel jaw pliers while the Band is on the portion of the person, or (ii) peening the pin while the Band is on the portion of the person.

* * * * *